US005180657A

United States Patent [19]

Fukazawa et al.

[11] Patent Number: 5,180,657

[45] Date of Patent: Jan. 19, 1993

[54] COLOR PHOTOGRAPHIC LIGHT-SENSITIVE MATERIAL OFFERING EXCELLENT HUE REPRODUCTION

[75] Inventors: Fumie Fukazawa; Yasushi Irie; Hiroshi Shimazaki; Katuya Yabuuchi; Satoru Shimba, all of Hino, Japan

[73] Assignee: Konica Corporation, Tokyo, Japan

[21] Appl. No.: 629,598

[22] Filed: Dec. 18, 1990

[30] Foreign Application Priority Data

| | | | |
|---|---|---|---|
| Dec. 22, 1989 | [JP] | Japan | 1-334481 |
| Mar. 14, 1990 | [JP] | Japan | 2-63871 |
| Apr. 7, 1990 | [JP] | Japan | 2-92721 |

[51] Int. Cl.[5] ..... G03C 1/46

[52] U.S. Cl. ..... 430/503; 430/504; 430/505; 430/574; 430/583; 430/588

[58] Field of Search ..... 430/505, 503, 504, 588, 430/574, 583

[56] References Cited

U.S. PATENT DOCUMENTS

| | | | |
|---|---|---|---|
| 4,686,175 | 8/1987 | Ogawa et al. | 430/505 |
| 4,770,980 | 9/1988 | Matejec et al. | 430/505 |
| 4,806,459 | 2/1989 | Makino et al. | 430/505 |
| 4,837,140 | 6/1989 | Ikeda et al. | 430/505 |
| 4,892,810 | 1/1990 | Aoki et al. | 430/553 |
| 5,024,925 | 6/1991 | Deguchi | 430/503 |
| 5,037,728 | 8/1991 | Shiba et al. | 430/505 |
| 5,077,182 | 12/1991 | Sasaki et al. | 430/504 |

FOREIGN PATENT DOCUMENTS

| | | |
|---|---|---|
| 115304 | 8/1984 | European Pat. Off. . |
| 160449 | 7/1987 | Japan . |
| 1474994 | 5/1977 | United Kingdom . |

OTHER PUBLICATIONS

Vervoort and Stappaerts, "A New Gevacolor Negative Film Type 682", The BKSTS Journal (Apr. 1980), pp. 148-153.

Hara, Kishimoto and Yamaryo, "Two New Types of Fujicolor Films: A Negative with Improved Characteristic and a Hot-Process Positive", SMPTE Journal, vol. 88, Jul. 1979, pp. 469-473.

*Primary Examiner*—Charles L. Bowers, Jr.
*Assistant Examiner*—Thomas R. Neville
*Attorney, Agent, or Firm*—Jordan B. Bierman

[57] ABSTRACT

A silver halide color photographic light-sensitive material which offers high chroma and excellent hue reproduction comprises a support having thereon a blue-sensitive silver halide emulsion layer, a green-sensitive silver halide emulsion layer and a red-sensitive silver halide emulsion layer, wherein the maximum sensitivity wavelength $\lambda_B$ of a spectral sensitivity distribution of said blue-sensitive silver halide emulsion layer is in the range of 410 nm$\leqq\lambda_B\leqq$470 nm; and the sensitivity of said blue-sensitive silver halide emulsion layer at 480 nm is not more than half of the sensitivity at said wavelength $\lambda_B$. Preferably, the maximum sensitivity wavelength $\lambda_G$ of said green-sensitive layer is in the range of 530 nm$\leqq\lambda_G\leqq$560 nm and the sensitivity of said green-sensitive layer at the wavelength of 500 nm is not less than one-fourth of the sensitivity at $SG_{max}$; the maximum sensitivity wavelength $\lambda_R$ of said red-sensitive layer is in the range of 595 nm$\leqq\lambda_R\leqq$625 nm and the maximum sensitivity of red-sensitive layer in the range of 400 nm to 480 nm is not less than 1.5% of the sensitivity of blue-sensitive layer at $\lambda_B$.

9 Claims, 3 Drawing Sheets

× : SAMPLE 201
△ : SAMPLE 202
□ : SAMPLE 203
○ : SAMPLE 204
⊙ : SAMPLE 205
● : ORIGINAL (1) : YELLOW REPRODUCED (2) : YELLOWISH GREEN REPRODUCED (3) : BLUISH GREEN REPRODUCED (4) : CLOTH COLOR REPRODUCED

1~8 = SAMPLE 301~308

COLOR PHOTOGRAPHIC LIGHT-SENSITIVE MATERIAL OFFERING EXCELLENT HUE REPRODUCTION

BACKGROUND OF THE INVENTION

1. Field of Industrial Application

The present invention relates to a color photographic light-sensitive material, more specifically a color photographic light-sensitive material which offers high chromaticness and excellent hue reproduction.

2. Description of Prior Art

In recent years, there have been noticeable image quality improvements in silver halide multiple layer color photographic light-sensitive materials.

Specifically, with respect to recently developed color photographic light-sensitive materials, all of the three major factors of image quality, i.e., graininess, sharpness and color reproduction have reached a fair level. For example, color prints and slide photographs obtained by users in ordinary color photography are not said to be significantly unsatisfactory.

However, with respect to one of the three factors, namely color reproducibility, the traditional problem of difficulty in reproduction for some colors remain unsolved, though there have been improvements in color purity. In other words, much remains unsatisfactory as to hue reproducibility. For example, the colors which reflect the light with a wavelength above 600 nm, i.e., purple colors such as purple and bluish purple, and green colors such as bluish green and yellowish green, are sometimes reproduced into colors by far different from the original color, which may disappoint the user.

The major factors associated with color reproduction include spectral sensitivity distribution and interlayer effect (interimage effect).

With respect to the interimage effect, the following is known. It is known that a compound which couples with the oxidation product of the color developing agent to form a development inhibitor or precursor thereof is added to a silver halide multiple-layered color photographic light-sensitive material. It is also known that an interimage effect is obtained and thus improvement in color reproduction is obtained by retarding the development of other coloring layers with the development inhibitor released from this DIR compound.

Also, in the case of color negative films, it is possible to obtain an effect similar to that of the interimage effect by using a colored coupler in an amount more than the amount to compensate the undesirable absorption.

However, when using a large amount of a colored coupler, it becomes very difficult to make a proper judgment for printing color and density correction, since the minimum film density decreases, which may often result in print color quality degradation.

These techniques have contributed to improvements in color reproduction, especially color purity. Recently commonly used inhibiting groups and what is called diffusive DIR whose precursor has high mobility have contributed to improvements in color purity significantly. However, the interimage effect is difficult to control with respect to its orientation, and is faulty in that it causes a hue change, though it improves color purity (control of interimage effect orientation is described in U.S. Pat. No. 4,725,529, for instance).

On the other hand, with respect to spectral sensitivity, U.S. Pat. No. 3,672,898 discloses an appropriate spectral sensitivity distribution to mitigate color reproduction variation among light sources used in taking pictures.

However, this does not provide any means of improving the poor hue reproduction described above.

Also, as has been known by those skilled in the art, hue reproduction for bluish purple, purple and similar colors is improved by shifting to the shorter wavelength side the spectral sensitivity of the red-sensitive layer. This approach is disclosed in Japanese Patent Publication Open to Public Inspection Nos. 20926/1978 and 131937/1984, for instance, but the methods described therein involve some shortcomings. One of them is that the hue reproduction for purple and other colors is insufficient to meet the essential requirement. Another shortcoming is that these techniques are accompanied by sensitivity reduction in the red-sensitive layer.

In Japanese Patent Publication Open to Public Inspection Nos. 34541/1986, which also discloses a method based on a combination of spectral sensitivity distribution and the interimage effect, an attempt is made to improve hue reproduction for the above-mentioned colors which are difficult to reproduce using color films, and it appears effective to some extent. In a typical example of this method, it is intended to obtain an interimage effect not only from the major wavelength for each of the blue-, green-and red-sensitive layers as conventional but also from a wavelength other than the major wavelength of each color-sensitive layer.

This method appears to be effective to some extent in the improvement of hue reproduction for some colors. However, to ensure the interimage effect, an interimage effect ensuring layer and another kind of light-sensitive silver halide are needed in addition to the essential blue-, green- and red-sensitive layers. In addition, increases in the coating amount of silver and the number of production processes pose a problem of high production cost. The obtained effect is not fully satisfactory.

SUMMARY OF THE INVENTION

As stated above, in the prior art methods, an attempt to improve hue reproduction results in red-sensitive layer desensitization, and hue reproduction is unsatisfactory for some colors.

The object of the present invention is to overcome these drawbacks and provide a silver halide color photographic light-sensitive material capable of exactly reproducing the hues which have been difficult to reproduce, particularly the hues of purple colors such as purple and bluish purple and the hues of green colors such as bluish green and green without being accompanied by red-sensitive layer desensitization.

The present inventors made intensive investigations and found that the object of the present invention described above is accomplished by the following constitution.

Accordingly, the object described above has been accomplished by a silver halide color light-sensitive material having at least one blue-sensitive silver halide emulsion layer (hereinafter also referred to as "blue-sensitive layer"), at least one green-sensitive silver halide emulsion layer (hereinafter also referred to as "green-sensitive layer") and at least one red-sensitive silver halide emulsion layer (hereinafter also referred to as "red-sensitive layer") on the support, wherein the maximum sensitivity wavelength $\lambda_B$ for the spectral sensitivity distribution of the blue-sensitive silver halide emulsion layer falls in the range of 410 nm≦$\lambda_B$≦470 nm and the sensitivity of the blue-sensitive silver halide emulsion layer at 480 nm does not exceed half of the sensitivity at the maximum sensitivity wavelength $\lambda_B$.

DETAILED DESCRIPTION OF THE INVENTION

Figure 1:
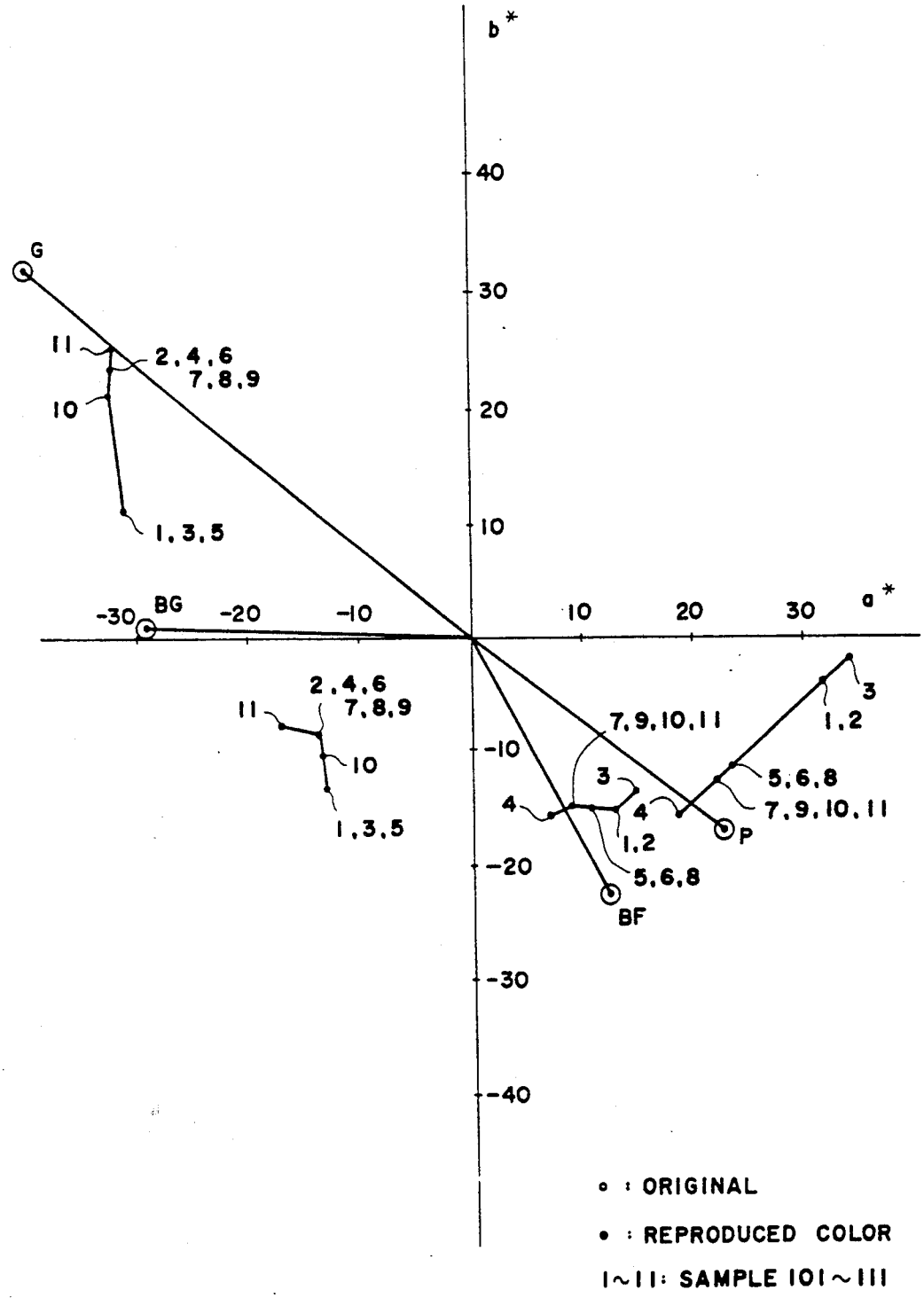
FIGS. 1 through 3 are chromaticity diagram showing the hue reproduction of the samples tested in an example of the present invention, in which color reproduction in each sample is plotted on the (a*, b*) plane of the (L*, a*, b*) color system.

The present invention is hereinafter described in more detail.

In the present invention, spectral sensitivity distribution is defined as a function of wavelength wherein the light-sensitive material is exposed to spectral light between 400 nm and 700 nm at intervals of several nanometers and on the basis of the amount of exposure which provides a given density at each wavelength is evaluated the sensitivity at that wavelength.

In the present invention, to obtain the above-mentioned constitution of the spectral sensitivity distribution, any appropriate means can be used. For example, a spectral sensitizing dye can be used to obtain a spectral sensitivity distribution as described above. Although there is no limitation on the spectral sensitizing dyes used in each color sensitive layer, good results are obtained, for example, by using a combination of spectral sensitizing dyes as shown below.

In the present invention, with respect to the spectral sensitivity distribution in the blue-sensitive layer, it is necessary for the maximum sensitivity wavelength $\lambda_B$ to fall in the range of 410 nm≦$\lambda_B$≦470 nm and for the sensitivity of the blue-sensitive layer at $\lambda$=480 nm not to exceed half of the maximum sensitivity of this blue-sensitive layer.

To obtain the constitution described above for the spectral sensitivity distribution in the blue-sensitive layer of the color photographic light-sensitive material of the present invention, various means can be used. Examples of such means include the method in which a given silver halide is spectrally sensitized with a sensitizing dye having an absorption in the desired wavelength band, the method in which the desired spectral sensitivity is obtained by optimizing the halogen composition and/or distribution in the silver halide crystal without using a sensitizing dye, and the method in which an appropriate optical absorbent is used in the light-sensitive material to obtain the desired spectral sensitivity distribution. These methods may be used in combination.

Examples of sensitizing dyes which can be used in the blue-sensitive silver halide emulsion layer to obtain the spectral sensitivity distribution of the present invention are given below, but these are not to be construed as limitative.

SS-1

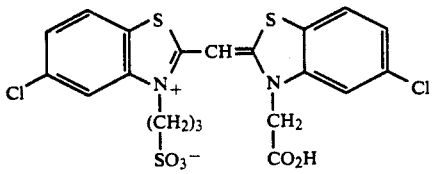

-continued

SS-2

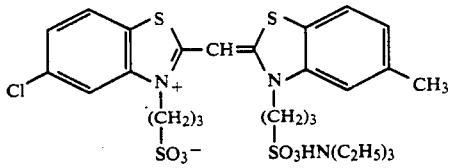

SS-3

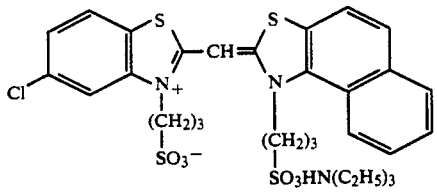

SS-4

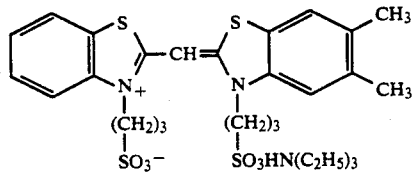

SS-5

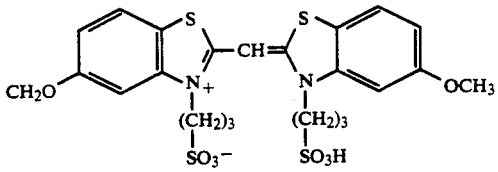

SS-6

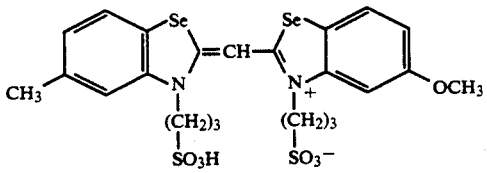

SS-7

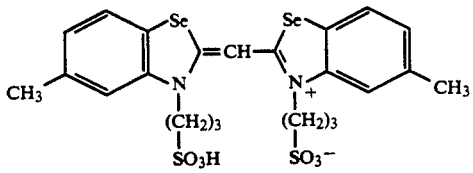

SS-8

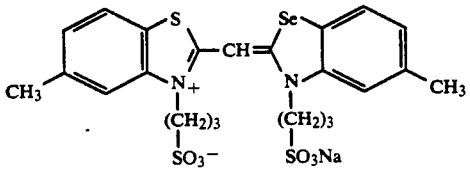

SS-9

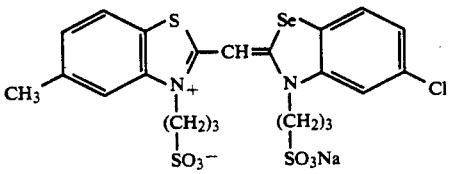

-continued

SS-10

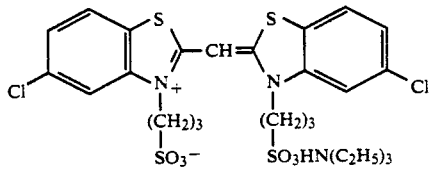

SS-11

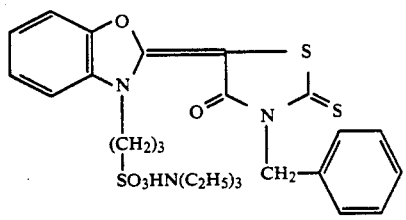

SS-12

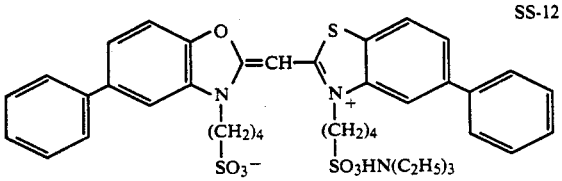

SS-13

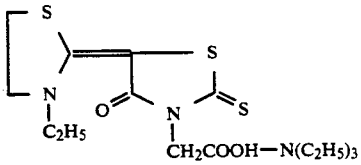

It is preferable that the maximum sensitivity wavelength $\lambda_R$ for the spectral sensitivity distribution in the red-sensitive silver halide emulsion layer falls in the range of 595 nm$\leqq\lambda_R\leqq$625 nm.

Accordingly, to make the spectral sensitivity distribution in the red-sensitive layer fall in the range described above, various means can be used, but it is preferable that the red-sensitive emulsion be spectrally sensitized with a combination of at least one kind of the spectral sensitizing dye represented by the following formula (I) and at least one kind of the spectral sensitizing dye represented by the following formula (II) or (III).

Formula (I)

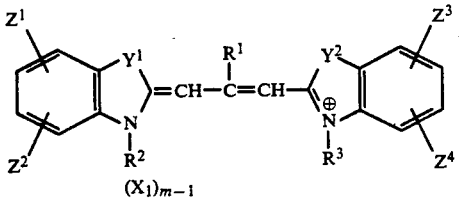

wherein $R^1$ represents a hydrogen atom, an alkyl group or an aryl group; $R^2$ and $R^3$ independently represent an alkyl group. $Y^1$ and $Y^2$ independently represent a sulfur atom or a selenium atom.

$Z^1$, $Z^2$, $Z^3$ and $Z^4$ independently represent a hydrogen atom, a halogen atom, a hydroxyl group, an alkoxy group, an amino group, an acyl group, an acylamino group, an acyloxy group, an aryloxy group, an alkoxycarbonyl group, an aryloxycarbonyl group, an alkoxycarbonylamino group, a sulfonyl group, a carbamoyl group, an aryl group, an alkyl group or a cyano group. $Z^1$ and $Z^2$ and/or $Z^3$ and $Z^4$ respectively may link together to form a ring. Also, $X_1$ represents a cation. m represents the integer 1 or 2; when the sensitizing dye forms an intramolecular salt, m represents 1.

Formula (II)

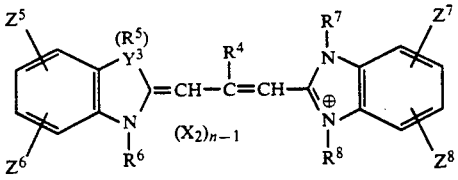

wherein $R^4$ represents a hydrogen atom, an alkyl group or an aryl group; $R^5$, $R^6$, $R^7$ and $R^8$ independently represent an alkyl group.

$Y^3$ represents a nitrogen atom, a sulfur atom or a selenium atom; when $Y^3$ is a sulfur atom or a selenium atom, it does not have the above $R^5$.

$Z^5$, $Z^6$, $Z^7$ and $Z^8$ independently represent a hydrogen atom, a halogen atom, a hydroxyl group, an alkoxy group, an amino group, an acyl group, an acylamino group, an acyloxy group, an aryloxy group, an alkoxycarbonyl group, an aryloxycarbonyl group, an alkoxycarbonylamino group, a sulfonyl group, a carbamoyl group, an aryl group, an alkyl group, a cyano group, an aryloxy group or a sulfonyl group. $Z^5$ and $Z^6$ and/or $R^7$ and $R^8$ respectively may link together to form a ring. Also, $X_2$ represents a cation. n represents the integer 1 or 2; when the sensitizing dye forms an intramolecular salt, n represents 1.

Formula (III)

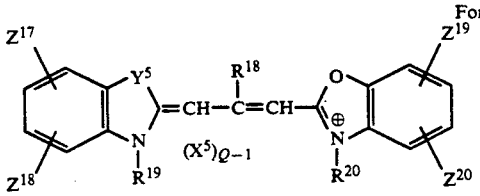

wherein $Y^5$ r atom or a selenium atom; $R^{18}$ represents a hydrogen atom, a lower alkyl group (e.g., methyl, ethyl, propyl) or an aryl group (e.g., a phenyl group). $R^9$ and $R^{20}$ independently represent a lower alkyl group (e.g., methyl, ethyl, butyl, a substituted group such as sulfoethyl, carboxypropyl or sulfobutyl). $Z^{17}$, $Z^{18}$, $Z^{19}$ and $Z^{20}$ independently represent a hydrogen atom, a halogen atom (e.g., chlorine, bromine, iodine, fluorine), a hydroxyl group, an alkoxy group (e.g., methoxy, ethoxy, propoxy, butoxy), an amino group (e.g., amino, methylamino, dimethylamino, diethylamino), an acylamino group (e.g., acetamido, propionamido, butylamido), an acyloxy group (e.g., acetoxy, propionoxy), an alkoxycarbonyl group (e.g., ethoxycarbonyl, propoxycarbonyl), an alkoxycarbonylamino group (e.g., ethoxycarbonylamino, propoxycarbonylamino, butoxycarbonylamino) an aryl group or a lower alkyl group (e.g., methyl, ethyl, propyl). $Z^{17}$, $Z^{18}$ and/or $Z^{19}$ and $Z^{20}$ independently may link together to form a ring. Examples of this ring include a benzene ring. $X^5$ represents a cation. Q represents the integer 1 or 2; when the sensitizing dye forms an intramolecular salt, Q represents 1.

Typical examples of the sensitizing dyes represented by formulas (I), (II) and (III) which can be used for the present invention are given below, but these are not to be construed as limitative to the present invention.
Examples of the compound represented by formula (I) are given below.
(I-1)
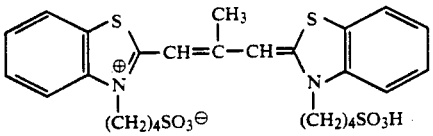
(I-2)
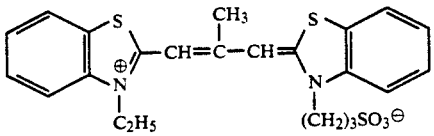
(I-3)
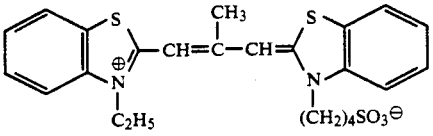
(I-4)
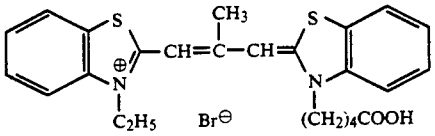
(I-5)
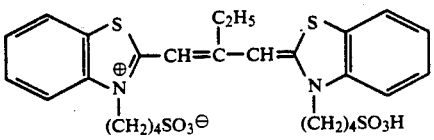
(I-6)
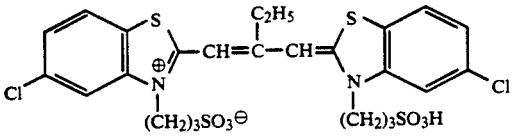
(I-7)
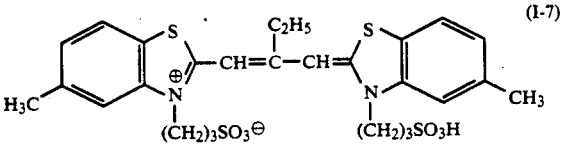
(I-8)
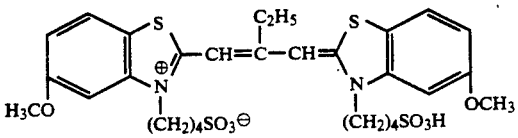
(I-9)
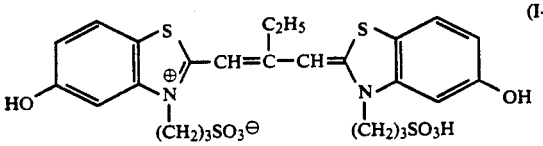
(I-10)
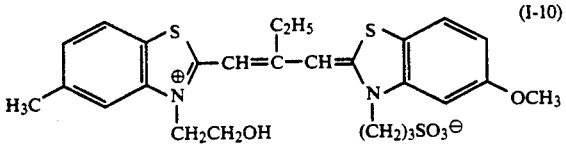
-continued
(I-11)
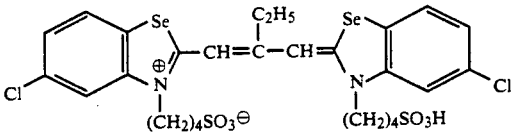
(I-12)
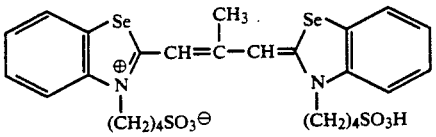
(I-13)
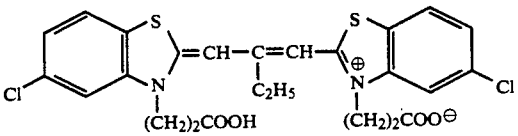
(I-14)
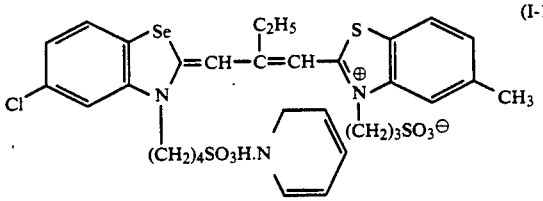
(I-15)
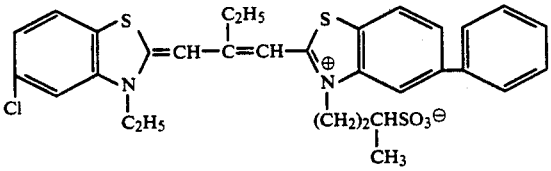
(I-16)
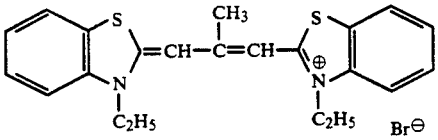
(I-17)
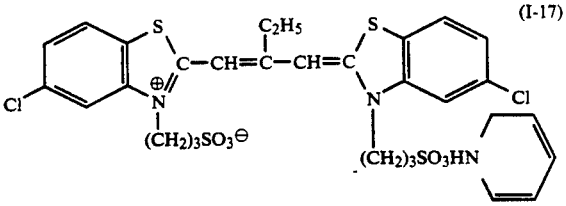
(I-18)
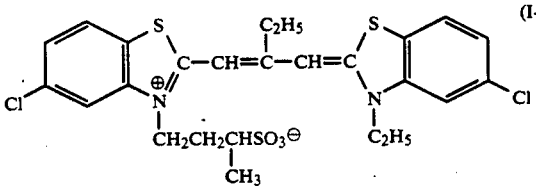
(I-19)
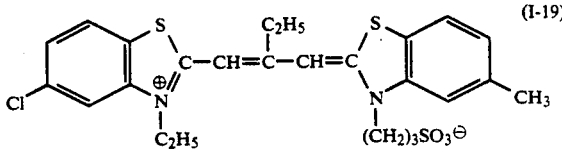

-continued
(I-20)
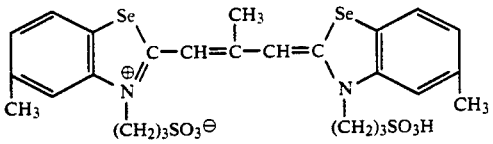
(I-21)
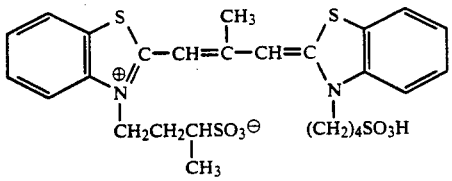
(I-22)
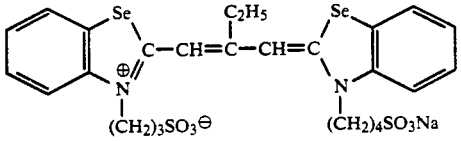
(I-23)
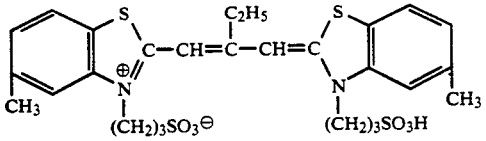
(I-24)
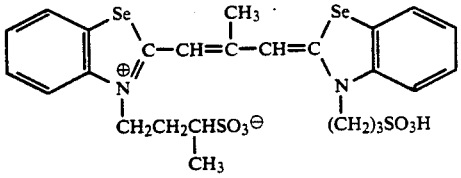
(I-25)
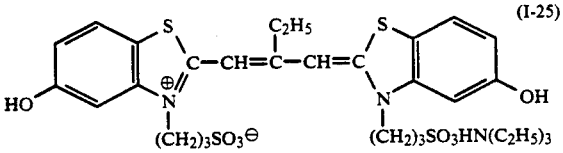
(I-26)
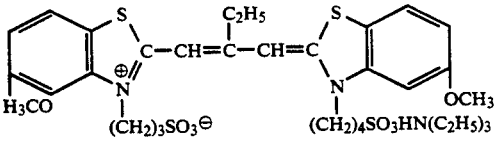
(I-27)
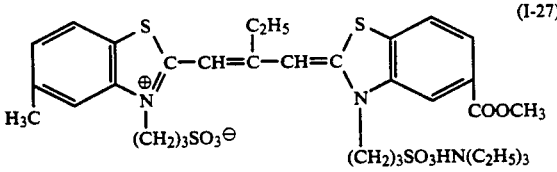
(I-28)
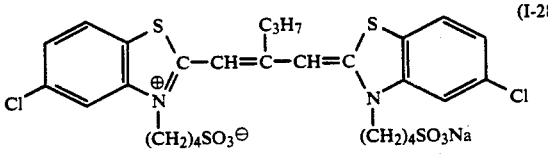
-continued
(I-29)
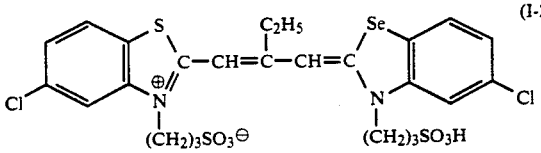
(I-30)
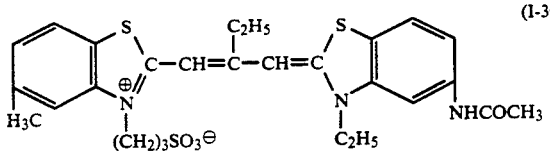
(I-31)
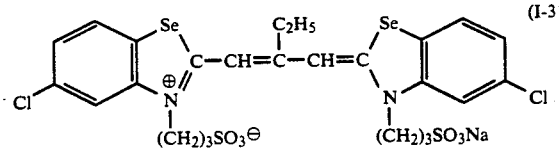
(I-32)
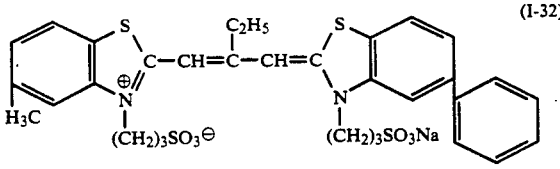
(I-33)
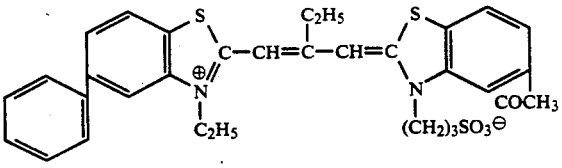
(I-34)
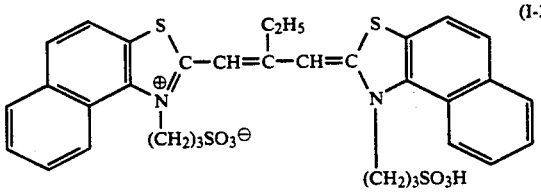
(I-35)
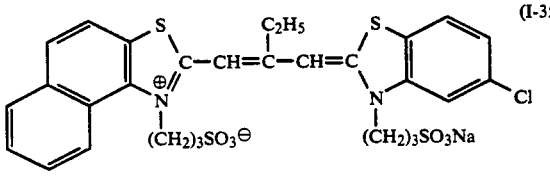
(I-36)
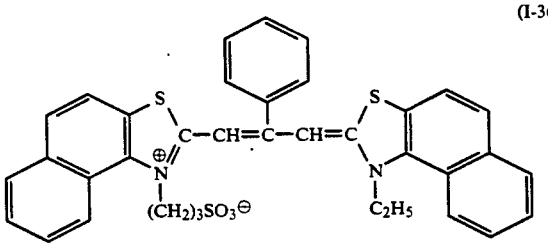

-continued
(I-37)
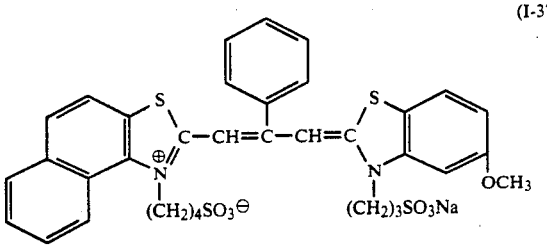
(I-38)
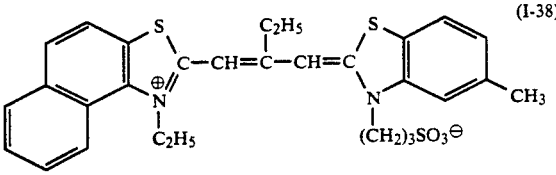
(I-39)
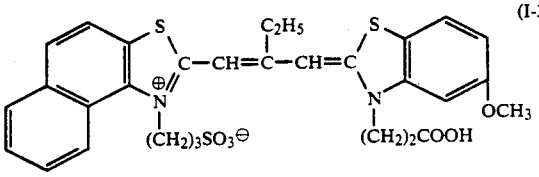
(I-40)
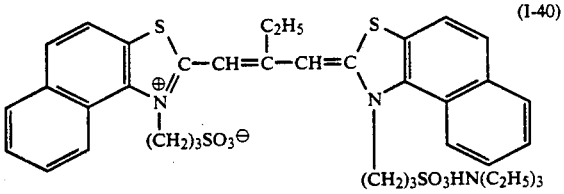
(I-41)
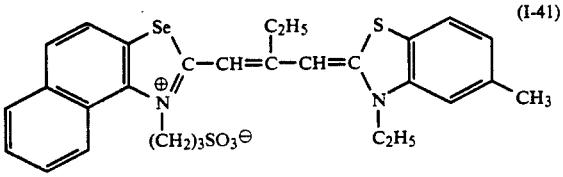
-continued
(I-42)
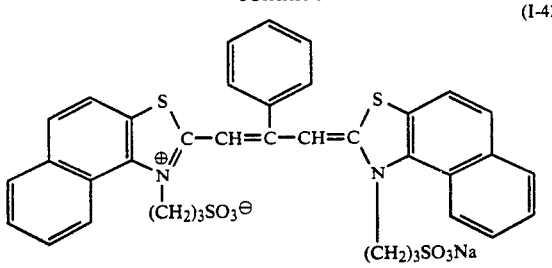
(I-43)
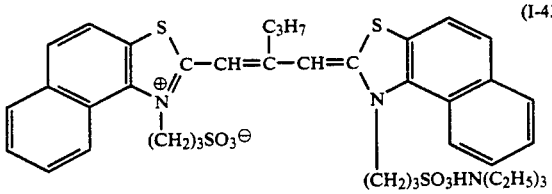
(I-44)
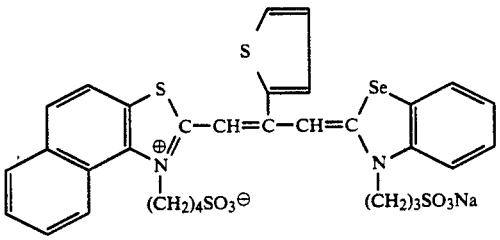
(I-45)
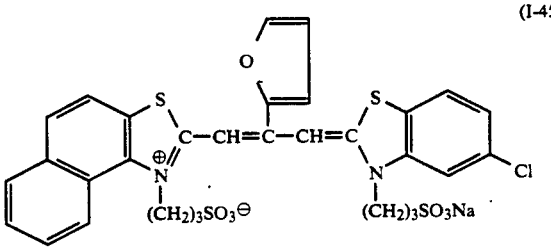
(I-46)
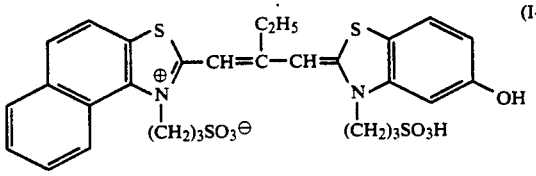
Examples of the compound represented by formula (II) are given below.
(II-1)
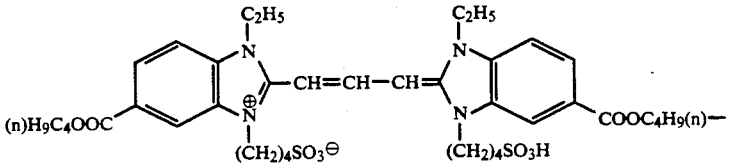
(II-2)
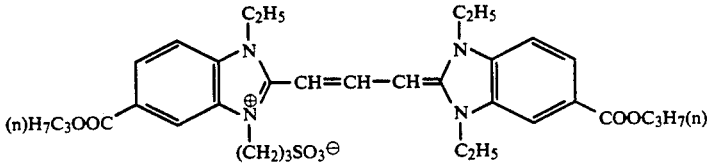

-continued
(II-3)
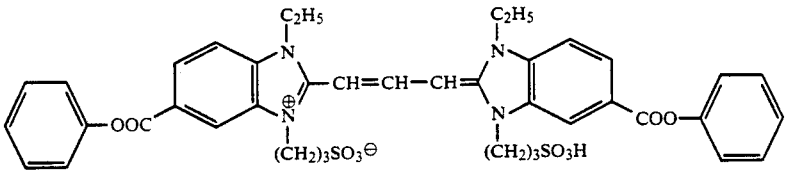
(II-4)
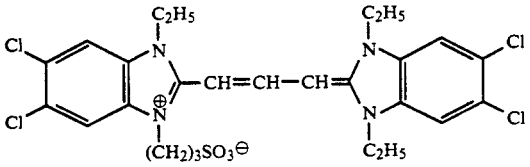
(II-5)
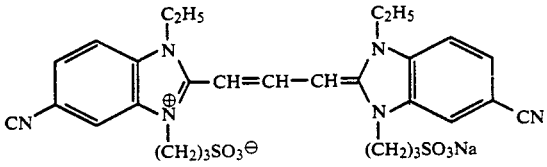
(II-6)
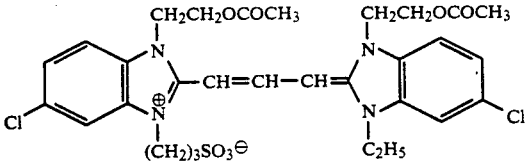
(II-7)
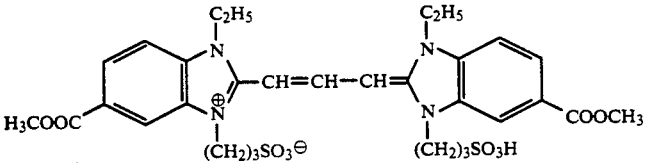
(II-8)
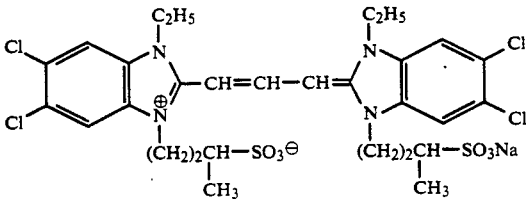
(II-9)
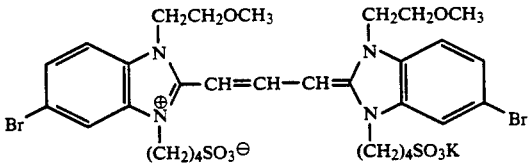
(II-10)
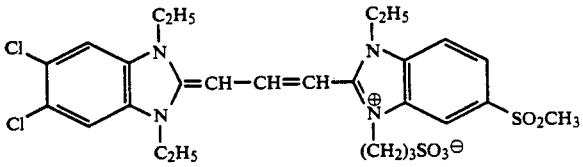
(II-11)
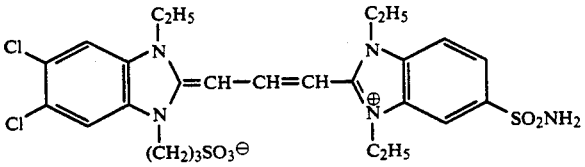

-continued
(II-12)
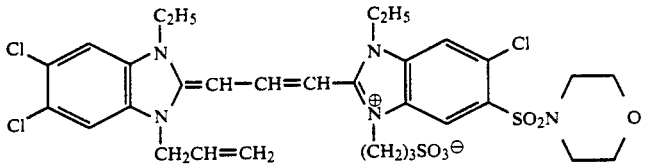
(II-13)
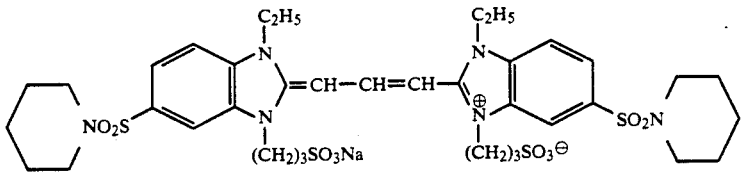
(II-14)
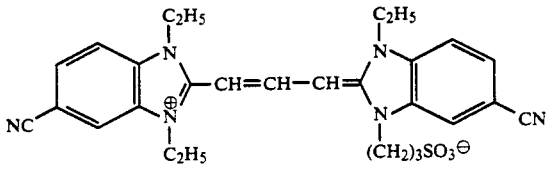
(II-15)
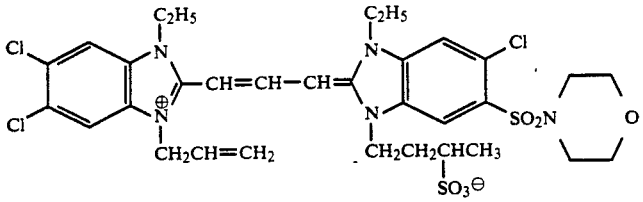
(II-16)
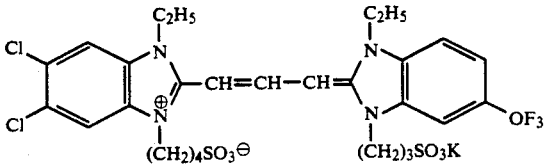
(II-17)
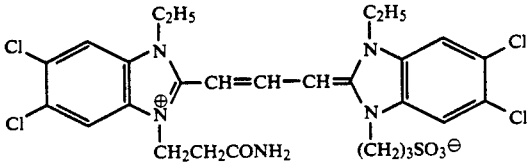
(II-18)
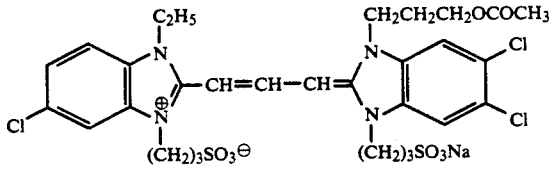
(II-19)
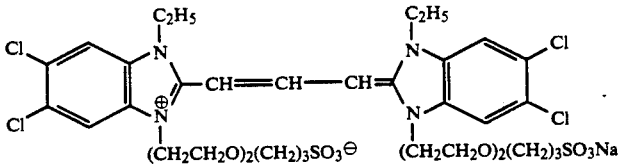
(II-20)
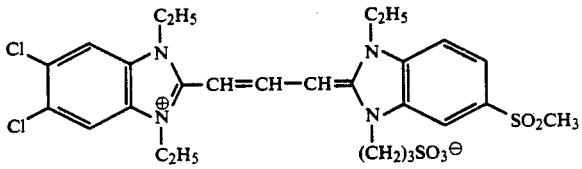

-continued
(II-21)
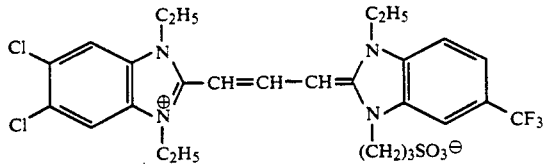
(II-22)
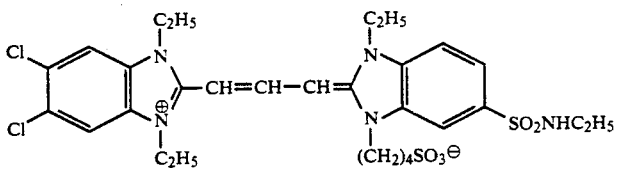
(II-23)
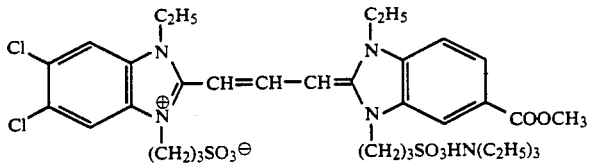
(II-24)
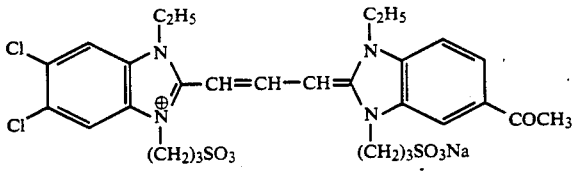
(II-25)
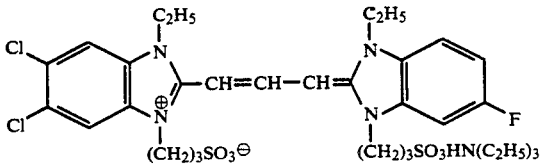
(II-26)
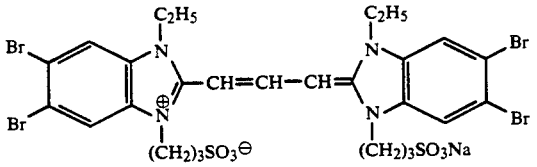
(II-27)
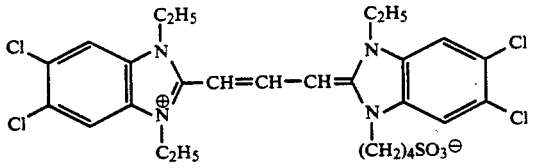
(II-28)
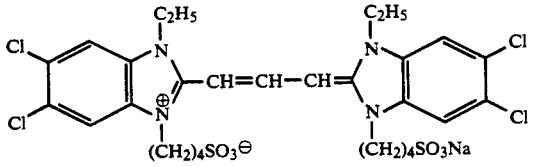
(II-29)
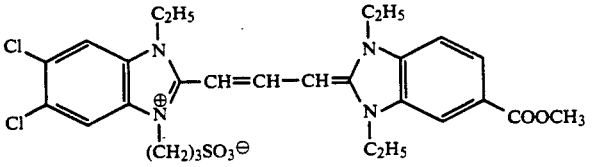

-continued
(II-30)
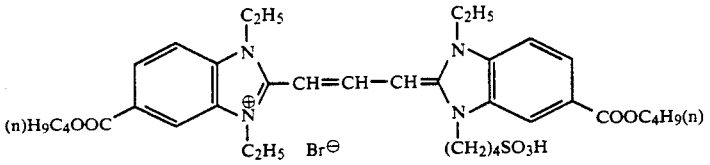
(II-31)
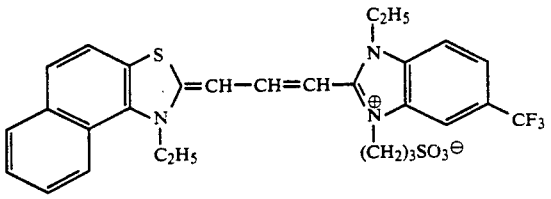
(II-32)
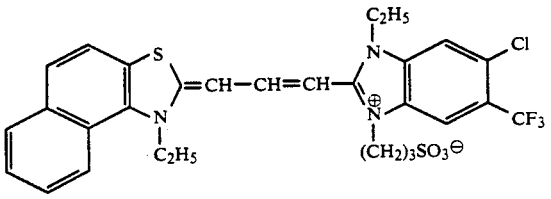
(II-33)
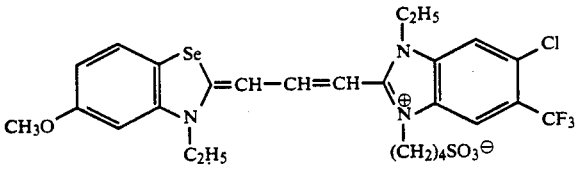
(II-34)
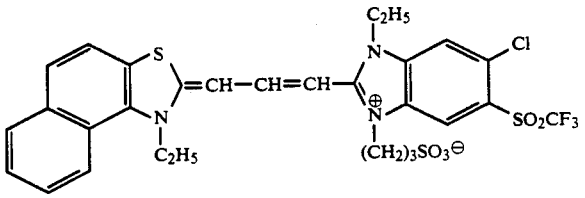
(II-35)
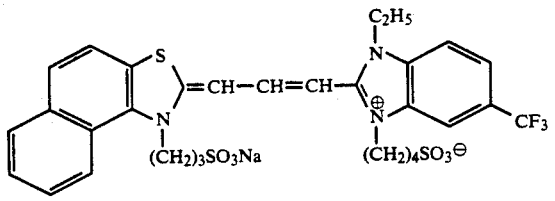
(II-36)
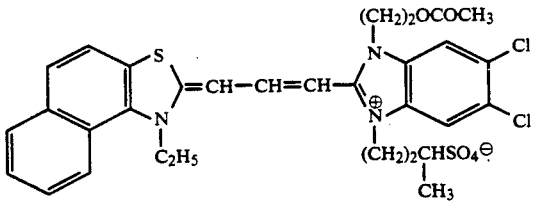
(II-37)
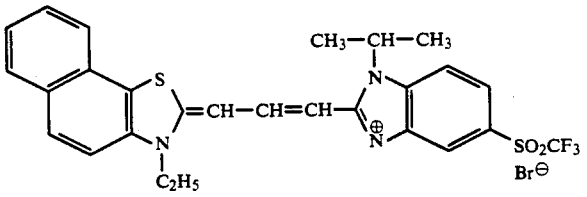

-continued
(II-38)
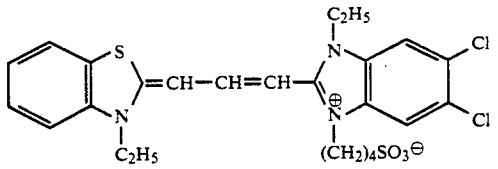
(II-39)
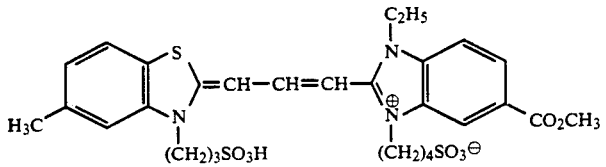
(II-40)
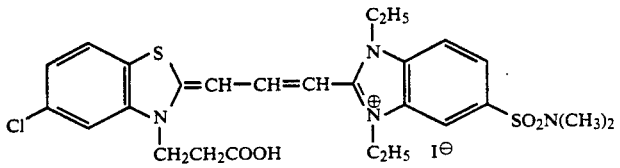
(II-41)
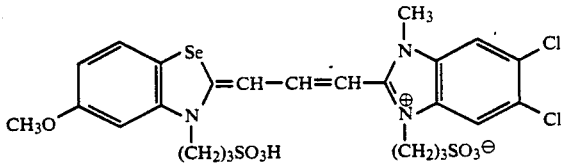
(II-42)
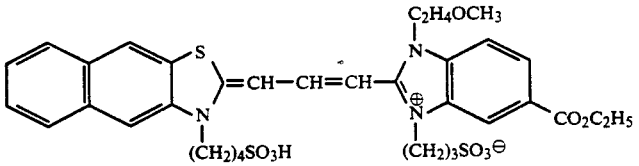
(II-43)
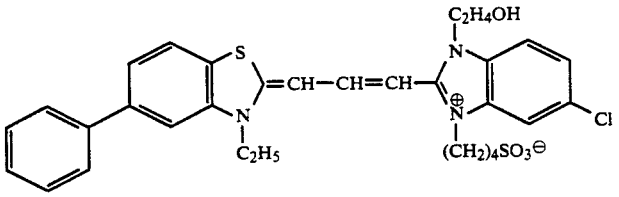
(II-44)
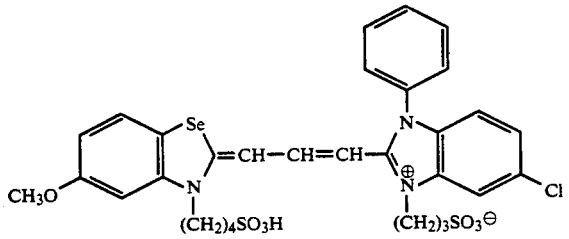
(II-45)
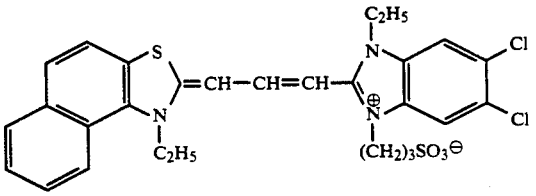

-continued
(II-46)
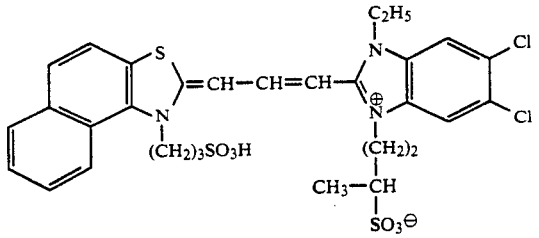
(II-47)
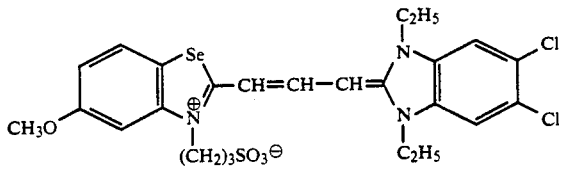
(II-48)
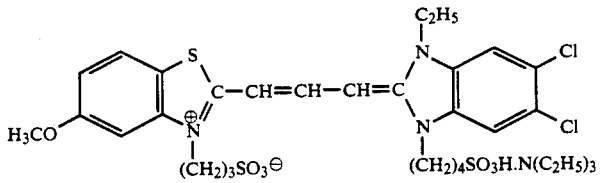
(II-49)
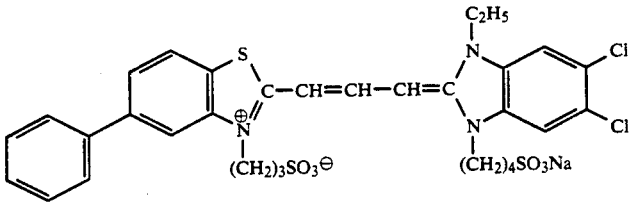
(II-50)
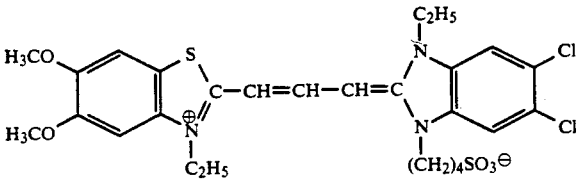
(II-51)
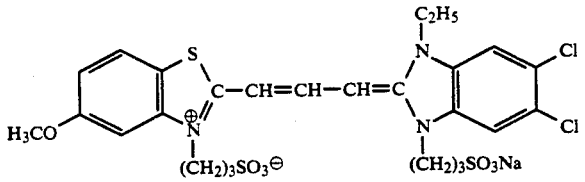
(II-52)
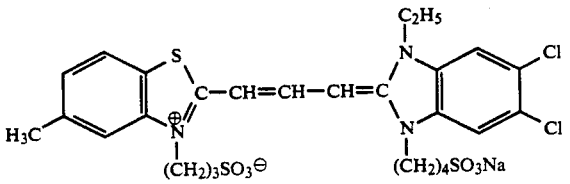
(II-53)
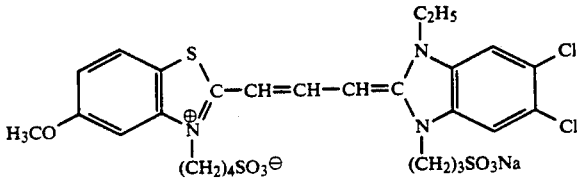

-continued
(II-54)
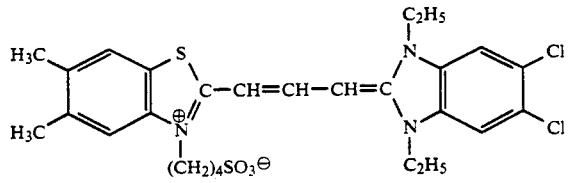
(II-55)
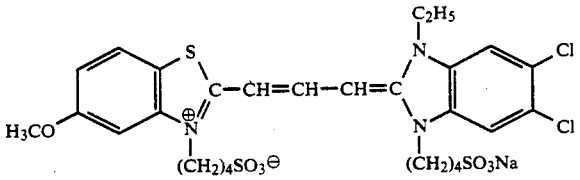
(II-56)
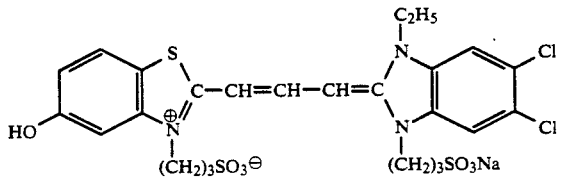
(II-57)
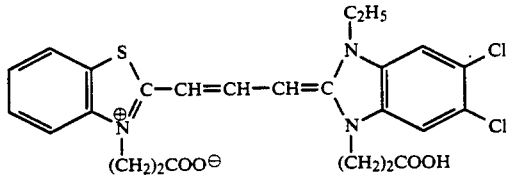
(II-58)
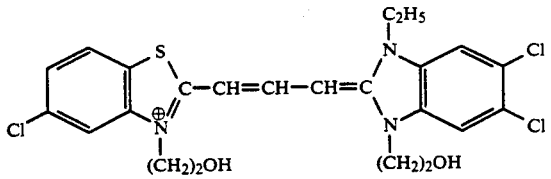
Examples of the compound represented by formula (III) are given below.
(III-1)
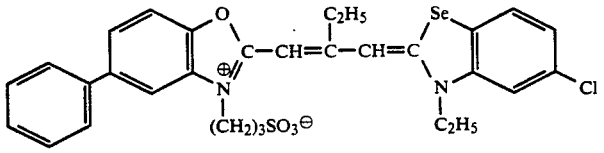
(III-2)
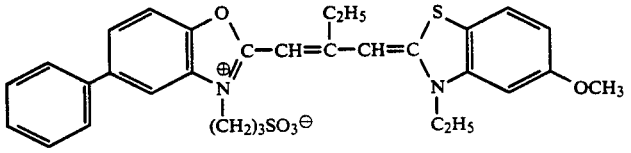
(III-3)
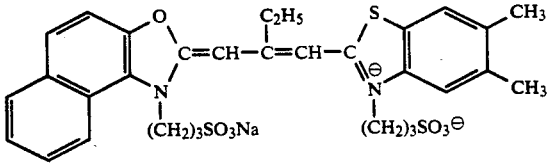

-continued
(III-4)
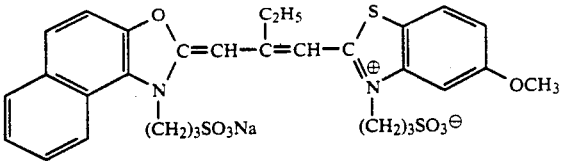
(III-5)
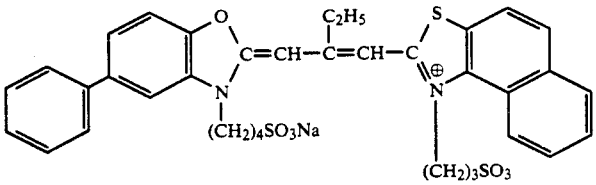
(III-6)
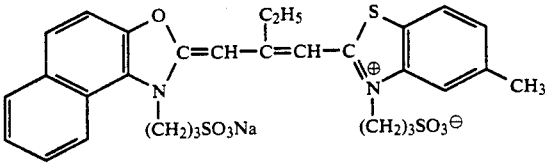
(III-7)
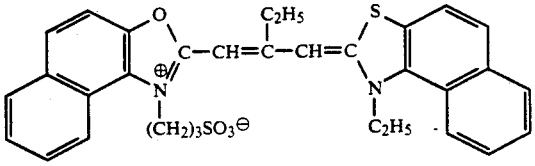
(III-8)
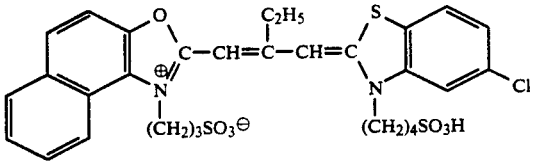
(III-9)
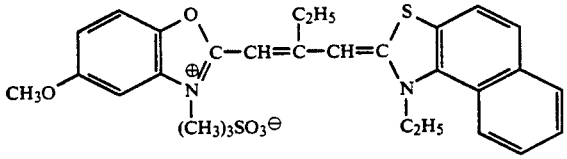
(III-10)
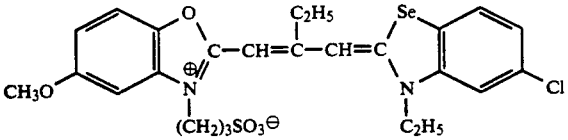
(III-11)
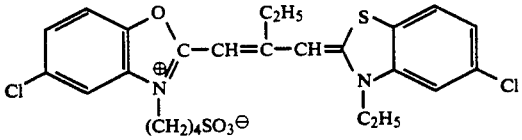
(III-12)
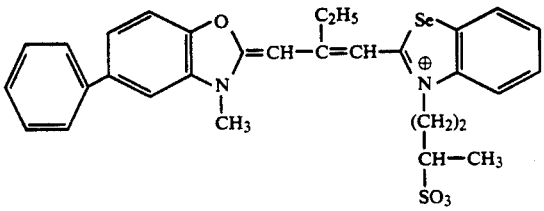

In addition to the sensitizing dyes represented by formulas (I), (II) and (III), the benzothiazoles and quinolones described in Japanese Patent Examined Publication No. 24533/1982 and the quinoline derivatives described in Japanese Patent Examined Publication No. 24899/1982, for instance, can also be used as supersensitizers as desired.

With respect to combinations of red sensitizing dyes, it is preferable to use in combination at east one kind of the sensitizing dye represented by formula (I) and at least one kind of the sensitizing dye represented by formula (II). Moreover, with respect to the structures of the sensitizing dyes used in this combination, it is preferable that $Y_1$ and $Y_2$ of the sensitizing dye represented by formula (I) are sulfur and $Y_3$ of the sensitizing dye represented by formula (II) is N-$R^a$. Here, N represents a nitrogen atom and $R^a$ represents an alkyl group.

It is preferable that with respect to the color photographic light-sensitive material of the present invention the wavelength $\lambda G_{max}$ which provides the maximum sensitivity for the spectral sensitivity distribution for a green-sensitive layer falls in the range of 530 nm $\leqq \lambda G_{max} \leqq 560$ nm, and the sensitivity at 500 nm $SG_{500}$ is not below one-fourth of the sensitivity $SG_{max}$ at $\lambda G_{max}$.

The spectral sensitivity distribution in the green-sensitive layer can easily be made to fall in the range described above by using singly or in combination the following sensitizing dyes in the green-sensitive layer.

Examples of sensitizing dyes which can be used in the green-sensitive layer are given below, but these are not to be construed as limitative.

An optimum amount of a sensitizing dye is added to obtain desired spectral sensitivity distribution. Generally, a preferred total amount of the sensitizing dyes used in the green-sensitive emulsion layer is $1\times10^{-5}$ to $5\times10^{-3}$ mol per mol silver.

OD-1

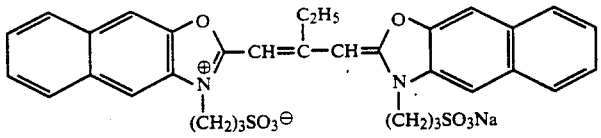

OD-2

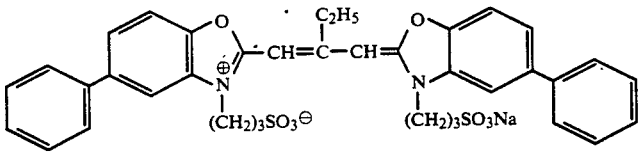

OD-3

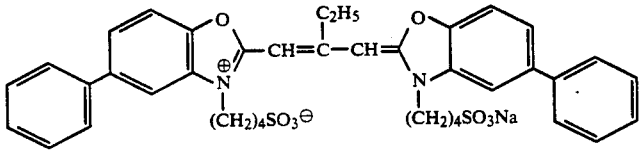

OD-4

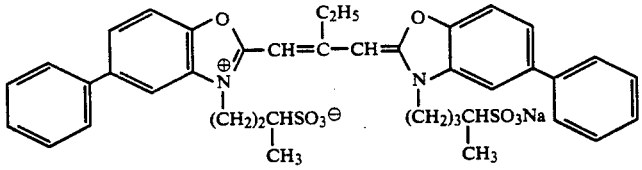

OD-5

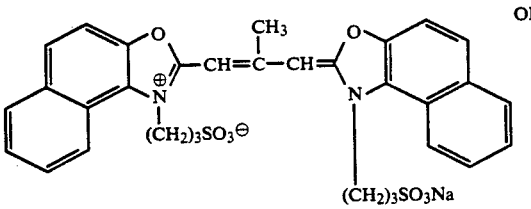

OD-6

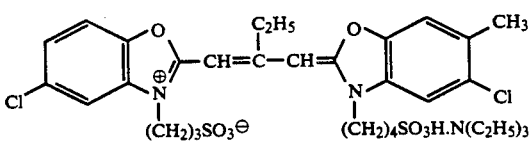

OD-7

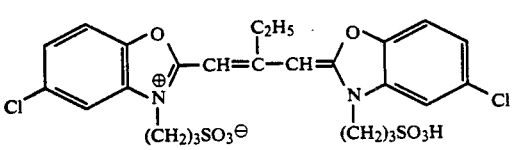

OD-8

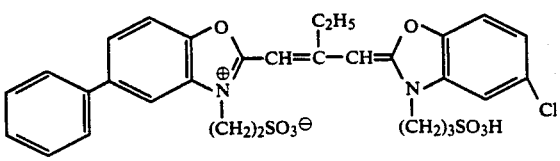

-continued
OD-9
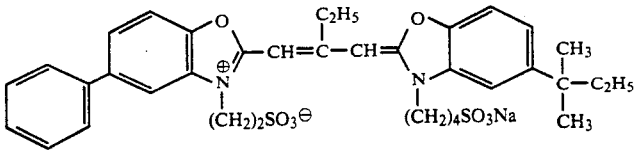
OD-10
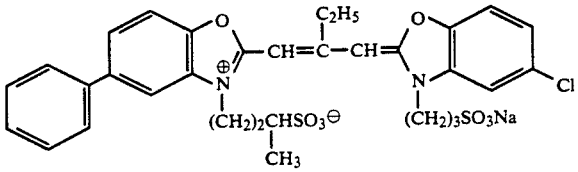
OD-11
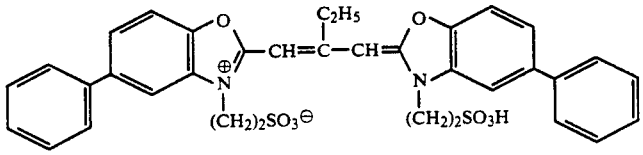
OD-12
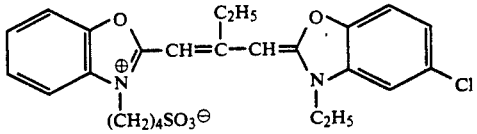
OD-13
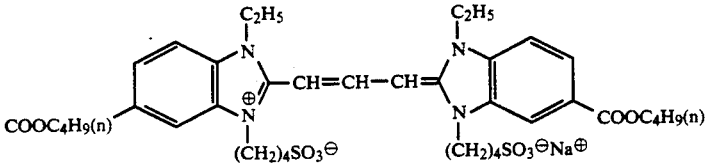
OD-14
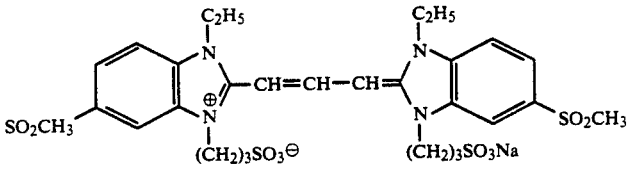
OD-15
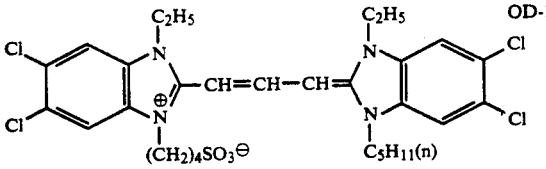
OD-16
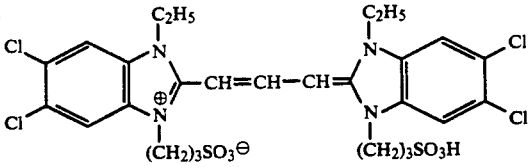
OD-17
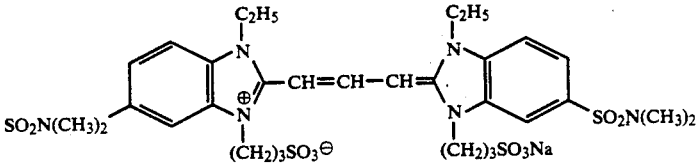
OD-18
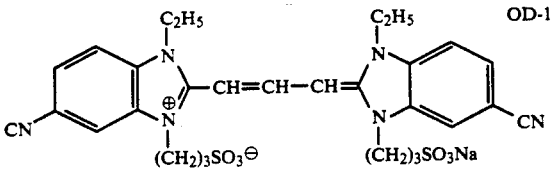
OD-19
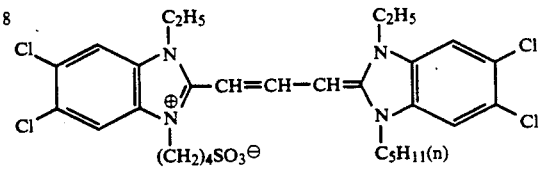

-continued

OD-20

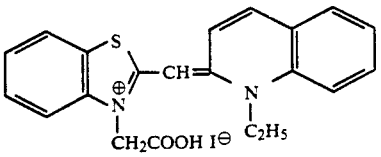

OD-21

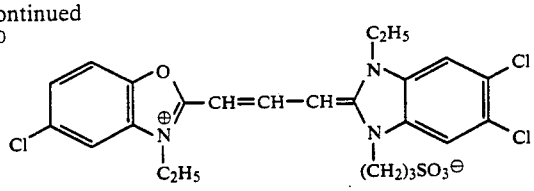

OD-22

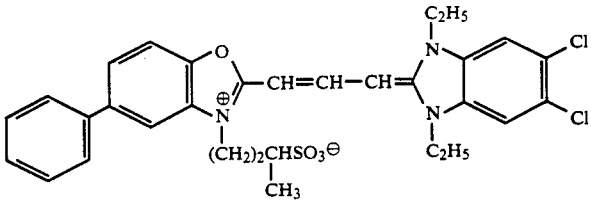

To obtain a preferred spectral sensitivity for the green-sensitive layer, a yellow filter may be used in the color photographic light-sensitive material of the present invention. Ordinary colloidal silver can be used for yellow filter. It is also possible to use a yellow colored magenta coupler or yellow nondiffusible organic dye in place of colloidal silver.

Any known yellow colored magenta coupler can be used, but the following examples may be given as preferred yellow colored magenta couplers.

YF-1

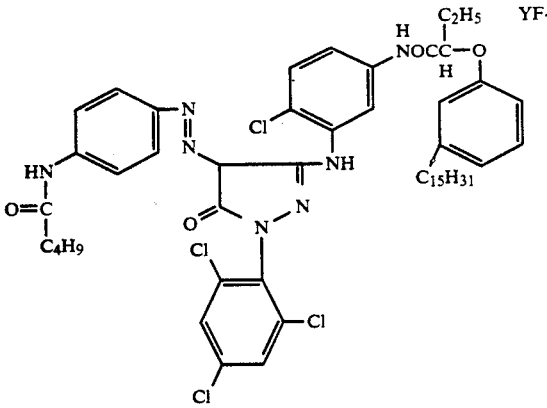

YF-2

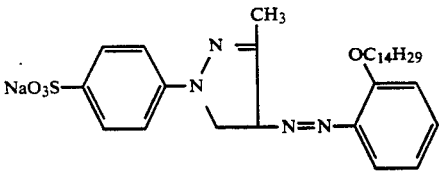

YF-3

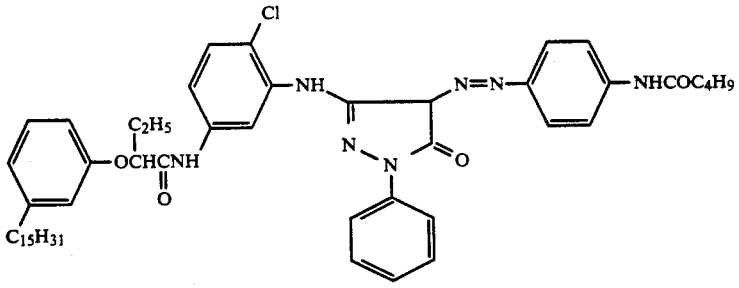

A yellow colored magenta couplers described above can be introduced into yellow filter by a known method in which the coupler is introduced into the silver halide emulsion layer, such as the method described in U.S. Pat. No. 2,322,027. The dispersion methods using a polymer described in Japanese Patent Examined Publication Nos. 39853/1976 and 59943/1976 may also be used.

Any yellow nondiffusible organic dye can be selected out of known ones, but the following examples may be given as preferred yellow nondiffusible organic dyes.

YF-4

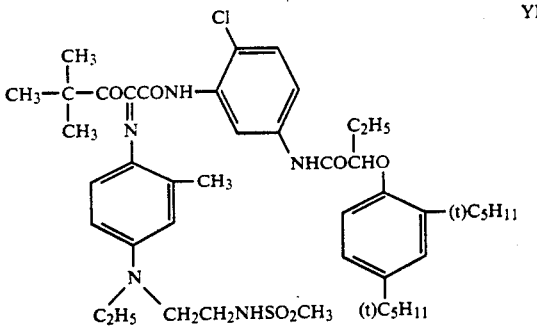

YF-5

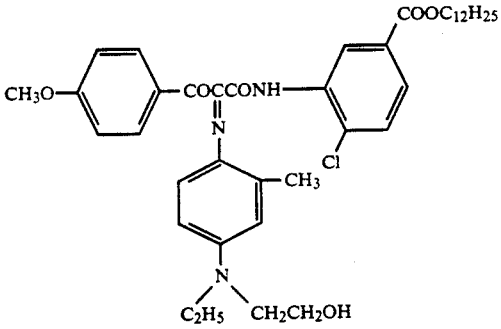

YF-6

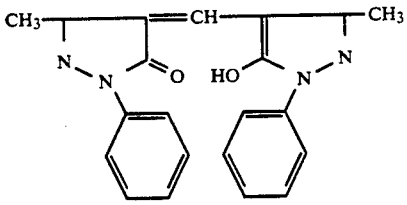

YF-7

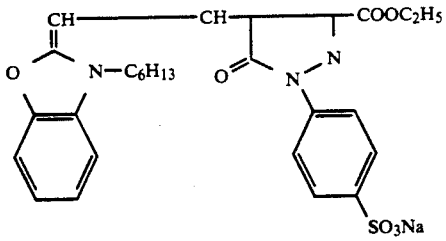

YF-8

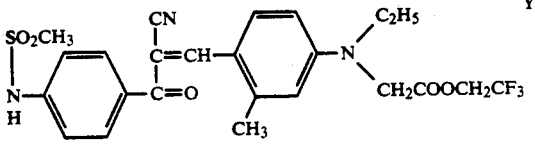

YF-9

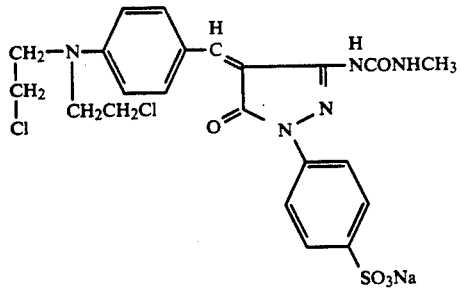

-continued

YF-10

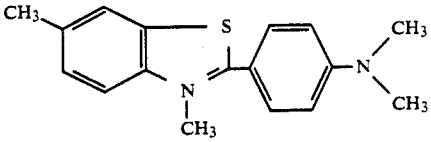

YF-11

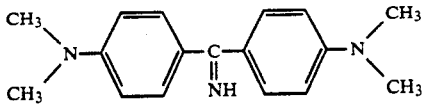

YF-12

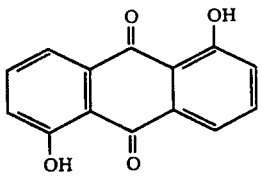

Known methods can be used to introduce a nondiffusible organic dye into the yellow filter. For example, when the organic dye used is soluble in oil, it can be introduced in the same manner as the method of introducing a yellow colored magenta coupler described above. When the organic dye is soluble in water, it can be introduced into hydrophilic colloid as an aqueous solution or an alkaline aqueous solution.

To obtain a preferred spectral sensitivity for the green-sensitive layer for the present invention, the amounts of colloidal silver grains, yellow colored magenta coupler and organic dye added can be optimized as necessary.

In the light-sensitive material of the present invention, it is preferable that the maximum sensitivity $SR_{max}$ of the red-sensitive silver halide emulsion layer in the wavelength band between 400 nm and 480 nm be not below 1.5% of the maximum sensitivity $SB_{max}$ of the blue-sensitive silver halide emulsion layer in the same wavelength band. Any means can be used to relatively increase the spectral sensitivity of the red-sensitive layer as described above. Examples of means for this purpose include the method in which the amount of yellow colloidal silver, which is normally used in color photographic light-sensitive materials to absorb irregular light in the specific light-sensitive wavelength band of the silver halide, is reduced. It is preferable to add a cyan coupler to the blue-sensitive silver halide emulsion layer to obtain this constitution. Preferred cyan couplers which can be added to the blue-sensitive layer when using this means are described below.

The cyan coupler added to the blue-sensitive layer may be a 2-equivalent cyan coupler or a 4-equivalent cyan coupler.

The 2-equivalent cyan coupler added to the blue-sensitive layer is preferably a cyan coupler represented by the following formula [CI].

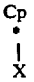

Formula [CI]

wherein Cp represents a coupler residue; * represents the coupling position of the coupler; X represents a group which is released upon dye formation via coupling with the oxidation product of an aromatic primary amine color developing agent.

Typical examples of the cyan coupler residue Cp are described in U.S. Pat. Nos. 2,367,531, 2,423,730, 2,474,293, 2,772,162, 2,895,826, 3,002,836, 3,034,892 and 3,041,236 and the above-mentioned Agfa Mitteilung (Band II), pp. 156-175 (1961). Of these substances, a phenol or naphthol is preferred.

Examples of the leaving group represented by X include monovalent groups such as a halogen atom, an alkoxy group, an aryloxy group, a heterocyclic oxy group, an acyloxy group, al alkylthio group, an arylthio group, a heterocyclic thio group,

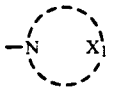

($X_1$ represents a group of atoms necessary to form a 5- or 6-membered ring together with the nitrogen atom in the formula and at least one atom selected out of the carbon atom, oxygen atom, nitrogen atom and sulfur atom), an acylamino group and a sulfonamido group, and divalent groups such as an alkylene group; when X is a divalent group, it forms a dimer.

Specific examples are given below.

Halogen atoms: Chlorine, bromide, fluorine.

Alkoxy groups:

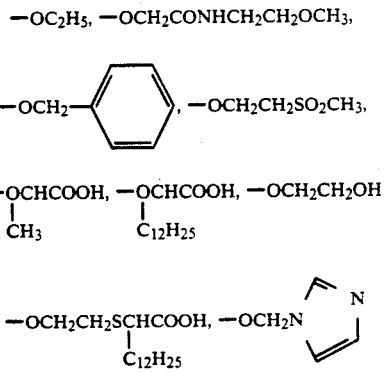

Alkoxy groups:

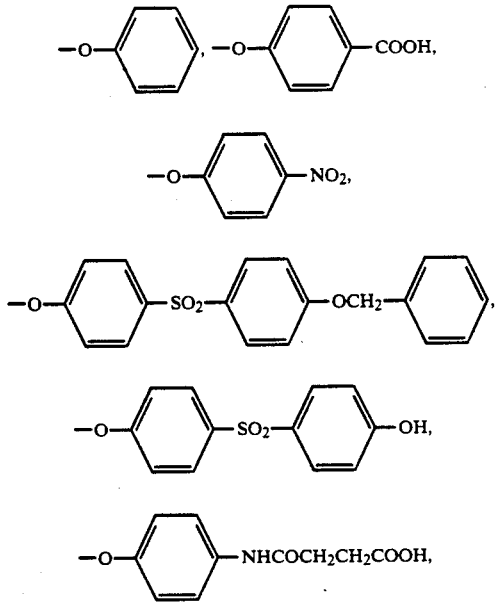

-continued

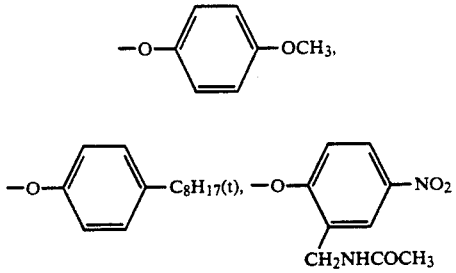

Heterocyclic oxy groups:

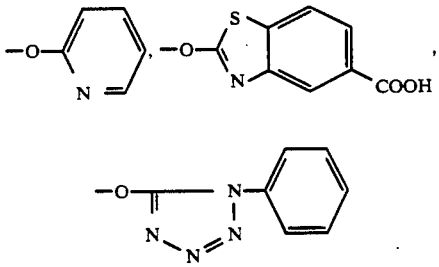

Acyloxy groups:

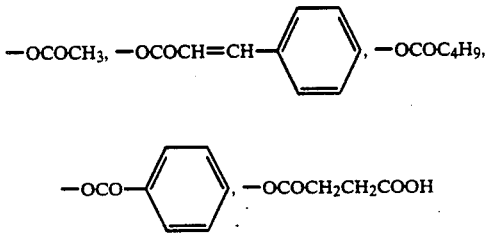

Alkylthio groups:

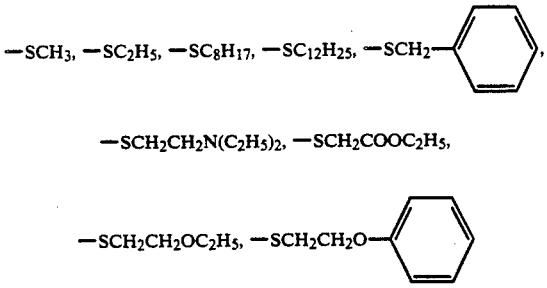

Arylthio groups:

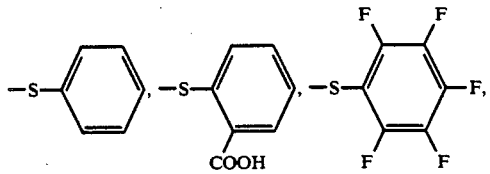

-continued
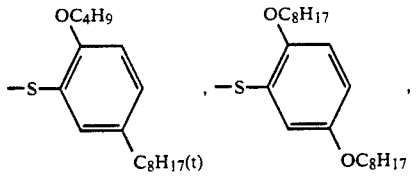
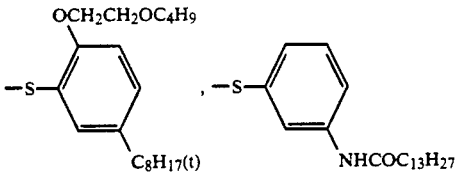
Heterocyclic thio groups:
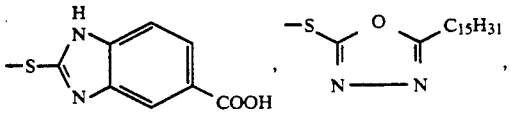
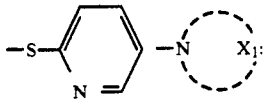
Pyrazolyl group, imidazolyl group, triazolyl group, tetrazolyl group,
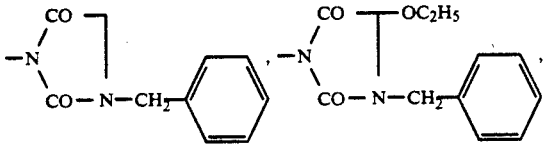
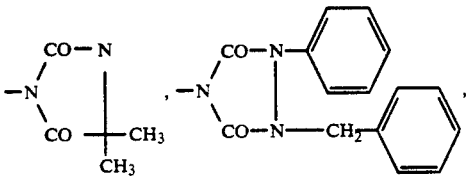
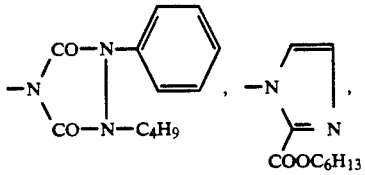
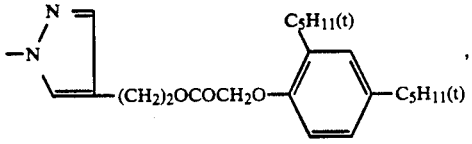
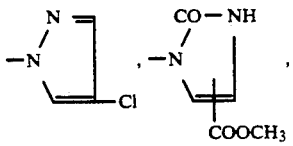
-continued
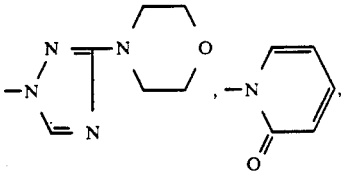
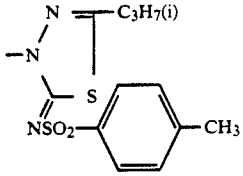
Acylamino groups:
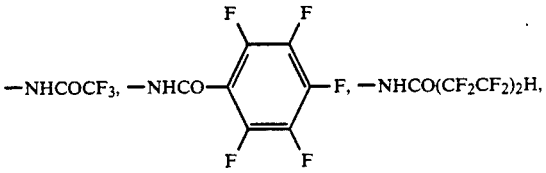
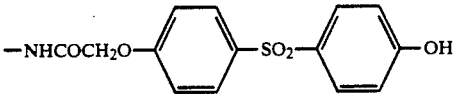
Sulfonamido groups:
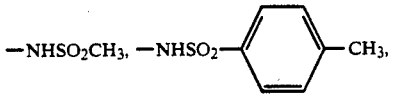
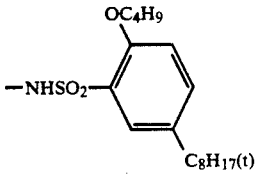
Alkylene groups:
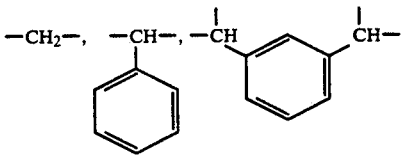
In the present invention, the 2-equivalent cyan coupler contained in blue-sensitive layer is preferably represented by the following formula [CII], [CIII] or [CIV].
Formula [CII]
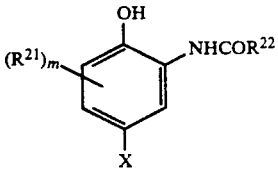

-continued

Formula [CIII]

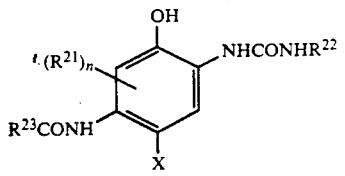

Formula [CIV]

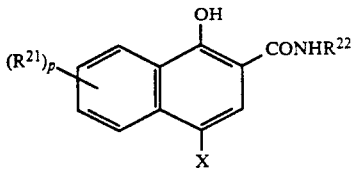

wherein $R^{21}$ represents a hydrogen atom or a substituent: $R^{22}$ and $R^{23}$ independently represent a substituent; m represents an integer of 1 to 3; n represents 1 or 2; p represent 1 to 5; when m, n or p is 2 or more, the $R^{21}$ units may be identical or not. X has the same definition as with the formula [CI].

Examples of the substituent represented by $R^{21}$ include a halogen atom and an alkyl, cycloalkyl, aryl and heterocyclic group which binds directly or via a divalent atom or group.

Examples of the divalent atom or group described above include oxygen atom, nitrogen atom, sulfur atom, carbonylamino, aminocarbonyl, sulfonylamino, aminosulfonyl, amino, carbonyl, carbonyloxy, oxycarbonyl, ureylene, thioureylene, thiocarbonylmaino, sulfonyl and sulfonyloxy.

Also, the alkyl, cycloalkyl, aryl and heterocyclic groups described above include those having a substituent. Examples of the substituent include halogen atoms, nitro, cyano, alkyl, alkenyl, cycloalkyl, aryl, alkoxy, aryloxy, alkoxycarbonyl, aryloxycarbonyl, carboxy, sulfo, sulfamoyl, carbamoyl, acylamino, ureide, urethane, sulfonamide, heterocycles, arylsulfonyl, alkylsulfonyl, arylthio, alkylthio, alkylamino, anilino, hydroxy, imido and acyl.

Examples of $R^{22}$ and $R^{23}$ include alkyl, cycloalkyl, aryl and heterocyclic groups, which include those having a substituent.

With respect to the 2-equivalent cyan couplers represented by the formulas [CII] through [CIV] given above, x is exemplified by the same as exemplified for [CI] above, with preference given to a hydrogen atom, an alkoxy group, an aryloxy group or a sulfonamido group.

With respect to the cyan couplers represented by formulas [CII] and [CIII], $R^{21}$, $R^{22}$ or X may form a dimer or higher polymer. With respect to the cyan coupler represented by formula [CIV], $R^{21}$, $R^{22}$, $R^{23}$ or X may form a dimer or higher polymer.

Examples of 2-equivalent cyan couplers which can be used for the present invention are given below, but these are not to be construed as limitative.

2-equivalent cyan couplers:

$C_2$-1

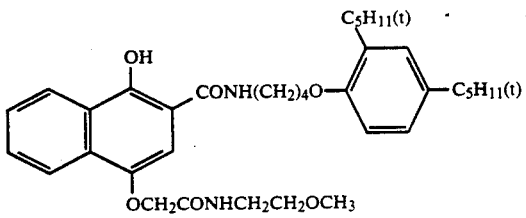

$C_2$-2

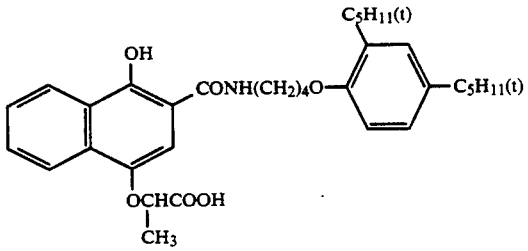

$C_2$-3

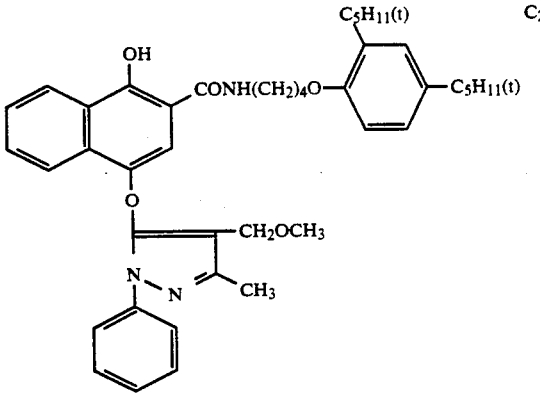

$C_2$-4

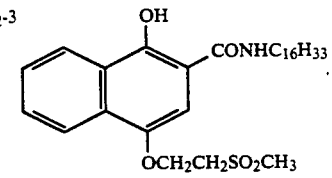

$C_2$-5

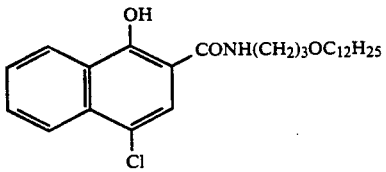

$C_2$-6

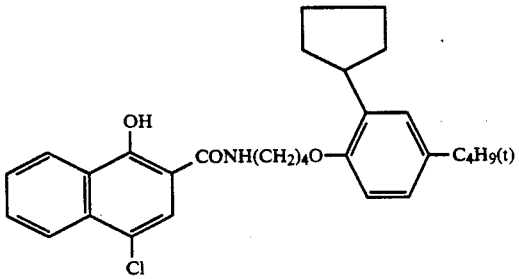

-continued
$C_2$-7
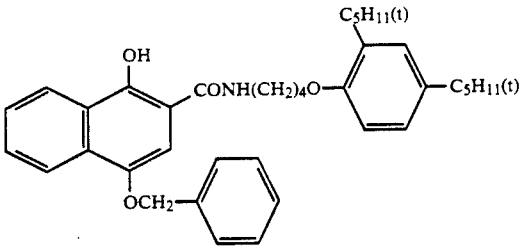
$C_2$-8
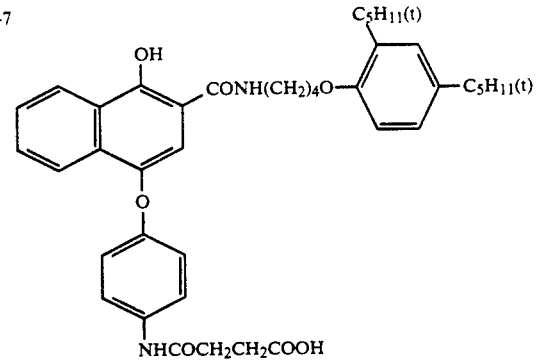
$C_2$-9
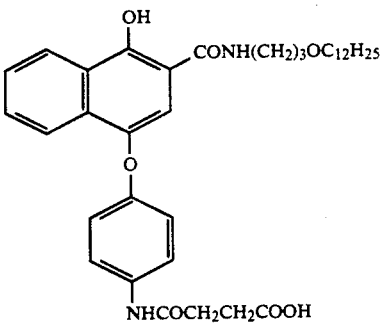
$C_2$-10
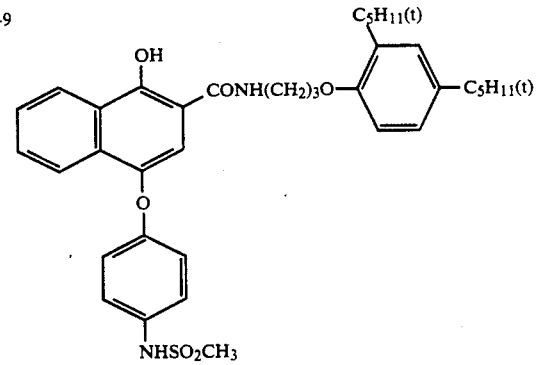
$C_2$-11
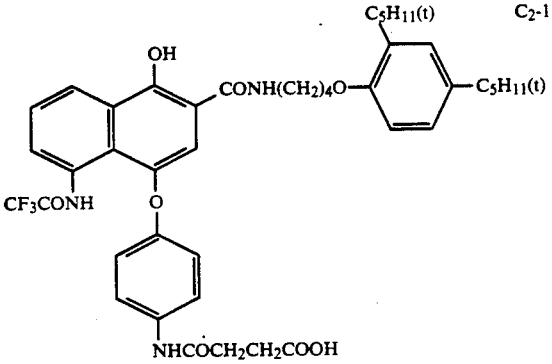
$C_2$-12
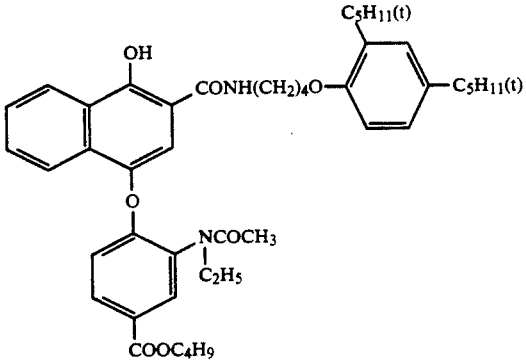
$C_2$-13
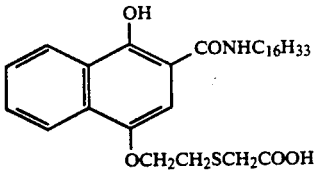
$C_2$-14
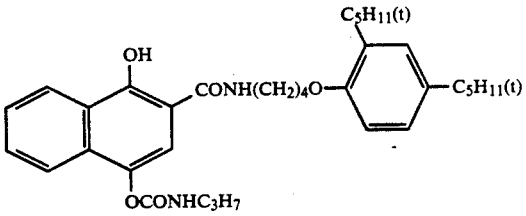
$C_2$-15
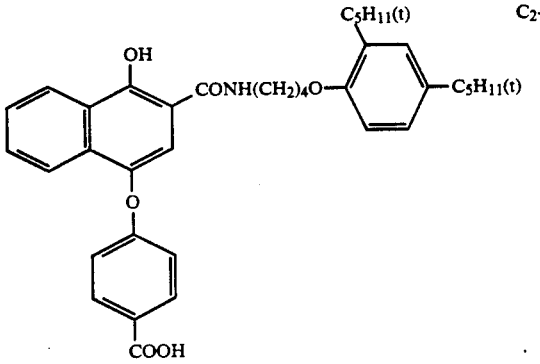
$C_2$-16
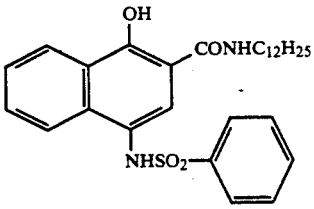

-continued
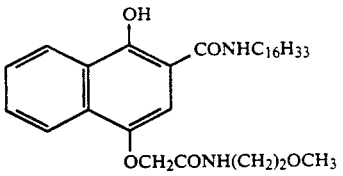
C2-17
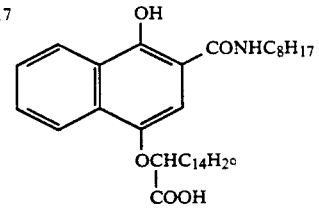
C2-18
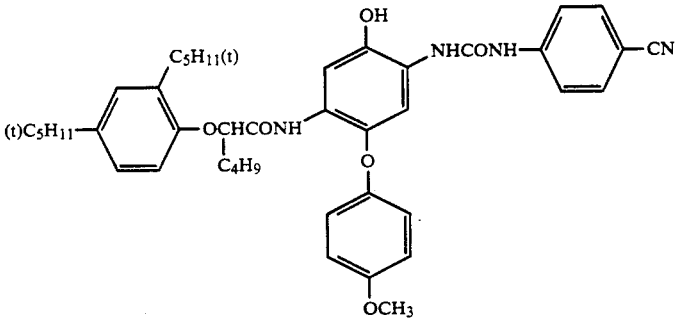
C2-19
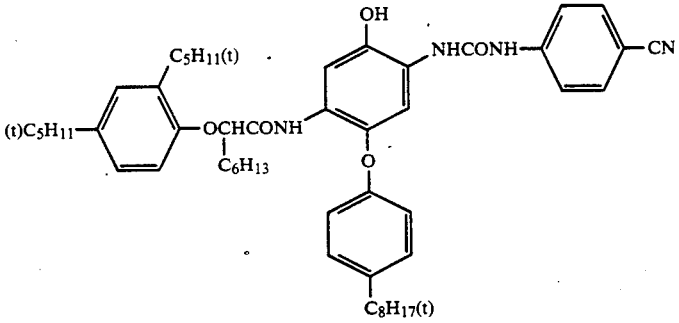
C2-20
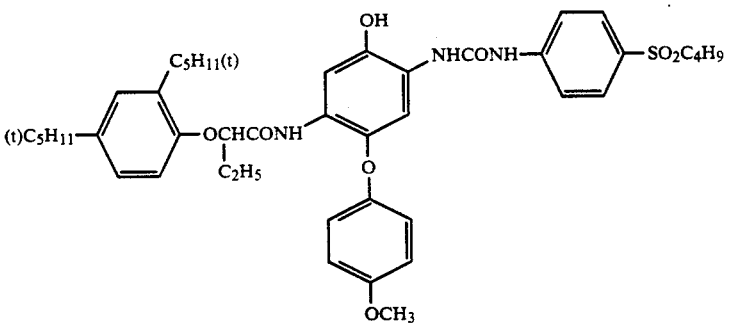
C2-21
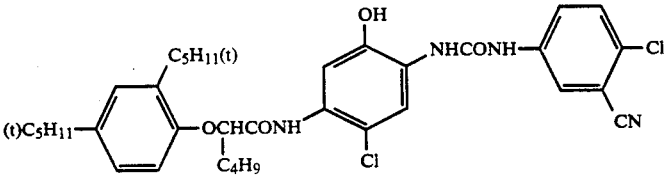
C2-22
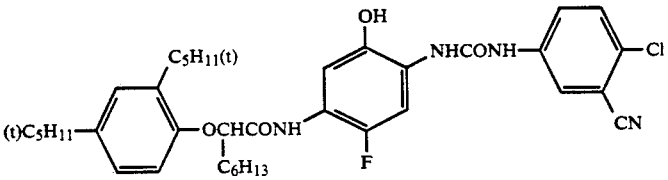
C2-23

-continued
$C_2$-24
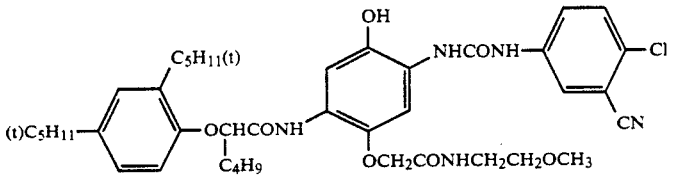
$C_2$-25
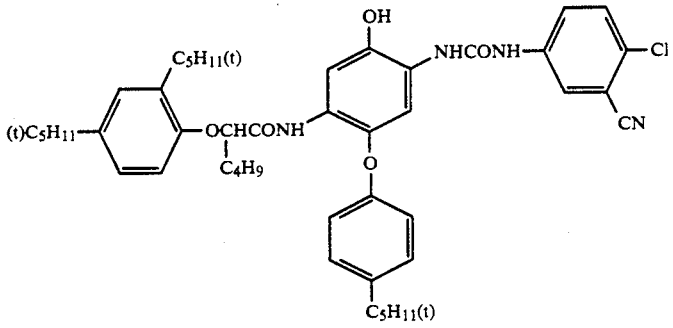
$C_2$-26
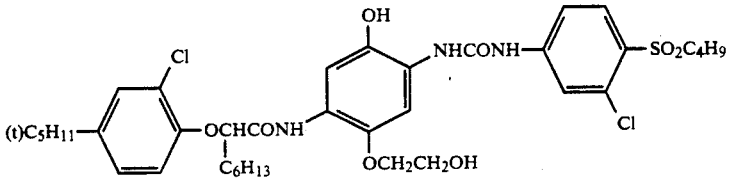
$C_2$-27
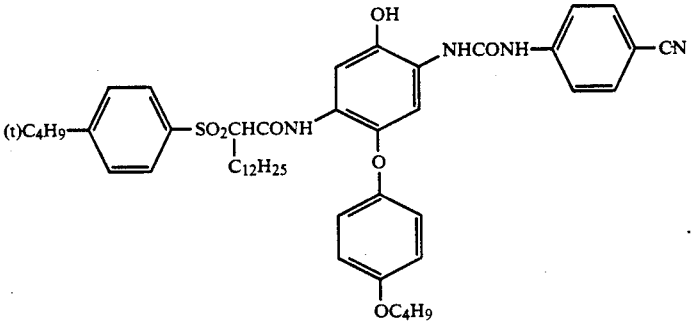
$C_2$-28
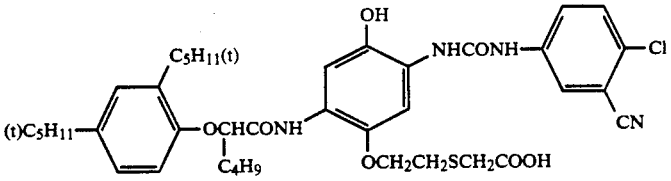
$C_2$-29
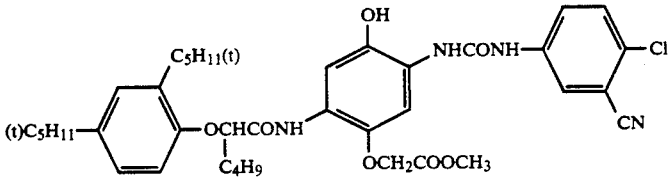
$C_2$-30
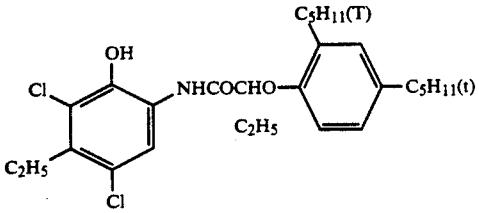
$C_2$-31
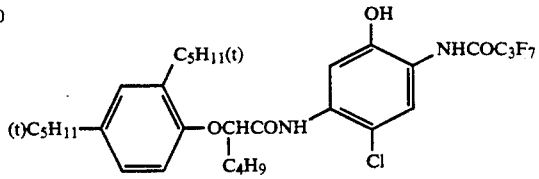

-continued

C2-32

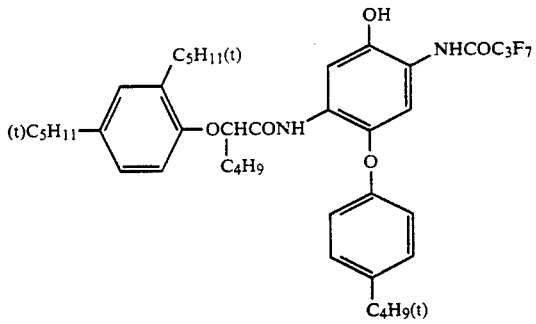

C2-33

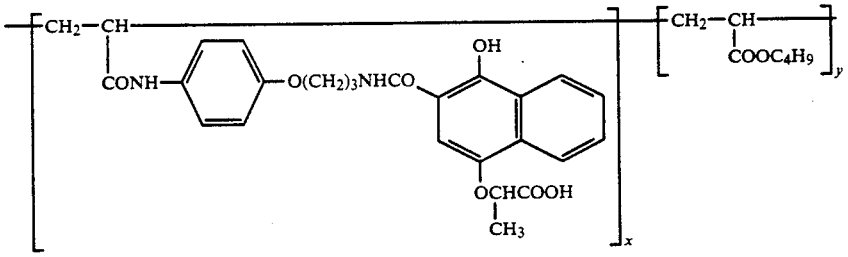

x:y = 40:60

C2-34

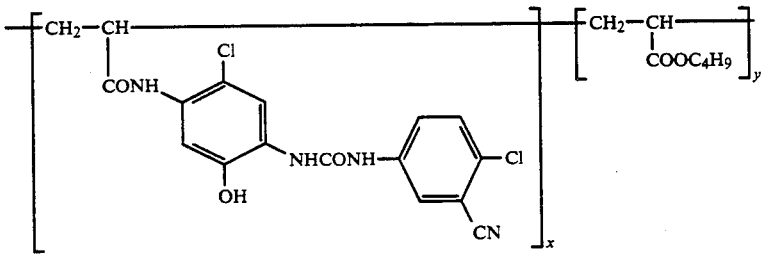

x:y = 50:50

Next, 4-equivalent couplers which can be used in the blue-sensitive layer for the present invention are described below.

The 4-equivalent coupler has no substituent at the coupling position and is preferably a phenol or naphthol.

More preferable 4-equivalent couplers are those represented by the formulas [CII] through [CIV] given above wherein X at the coupling position is a hydrogen atom. In this case, examples of $R^{21}$ through $R^{23}$ include the examples given with respect to formulas [CII] through [CIV] above, including those wherein a dimer or higher polymer is formed at $R^{21}$ through $R^{23}$.

Examples of 4-equivalent couplers which can be used for the present invention are given below, but these are not to e construed as limitative.

4-equivalent cyan couplers:

C4-1

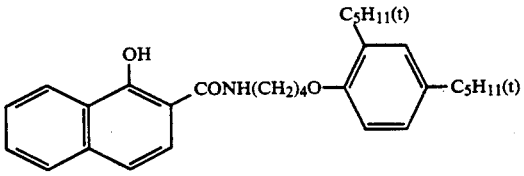

C4-2

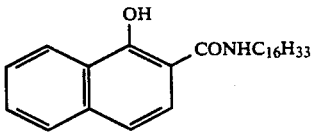

C4-3

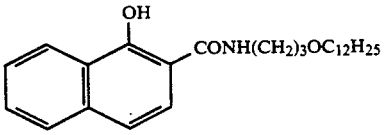

-continued
C4-4
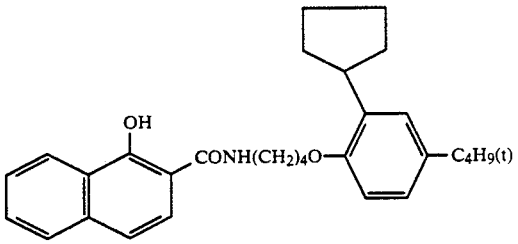
C4-5
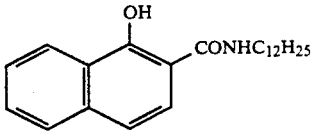
C4-6
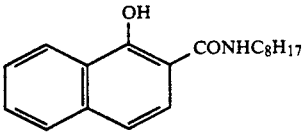
C4-7
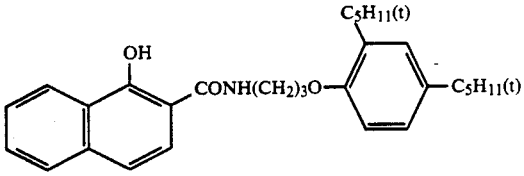
C4-8
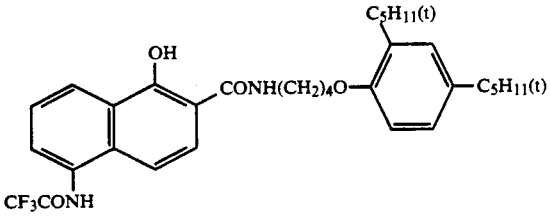
C4-9
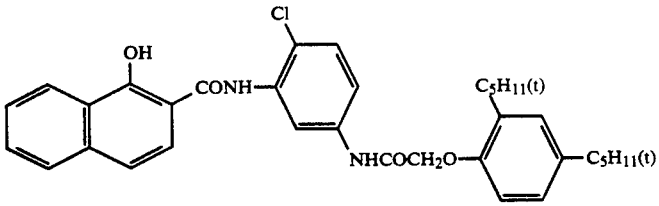
C4-10
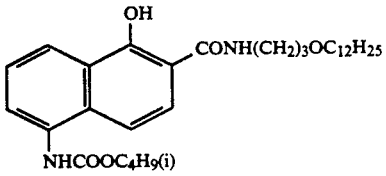
C4-11
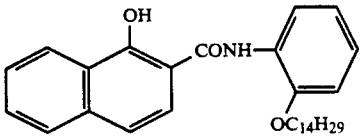

-continued
$C_4$-12
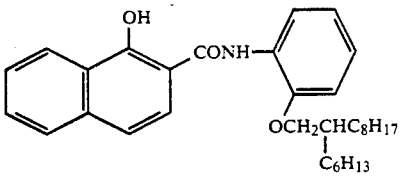
$C_4$-13
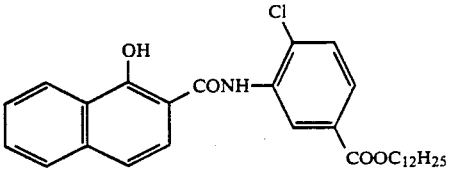
$C_4$-14
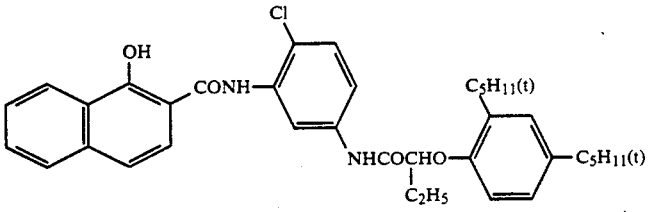
$C_4$-15
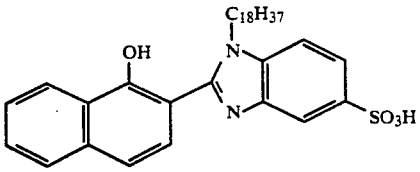
$C_4$-16
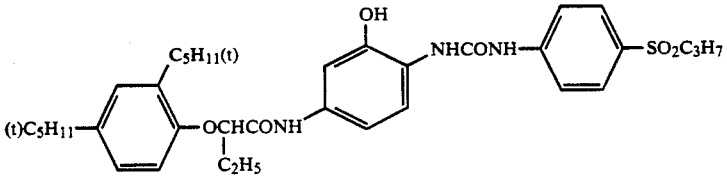
$C_4$-17.
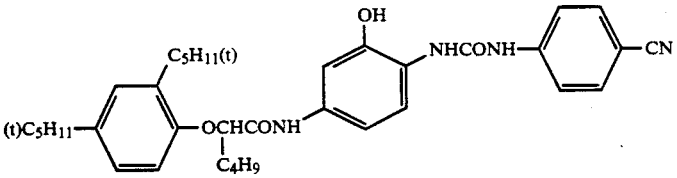
$C_4$-18
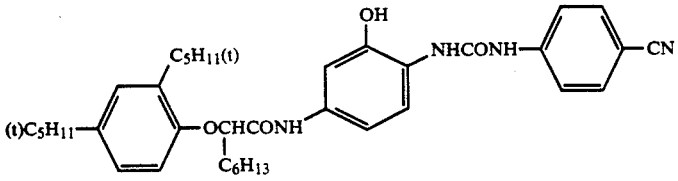
$C_4$-19
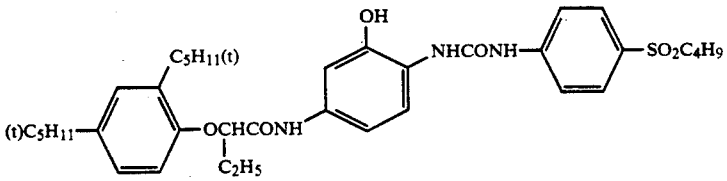

-continued
C4-20
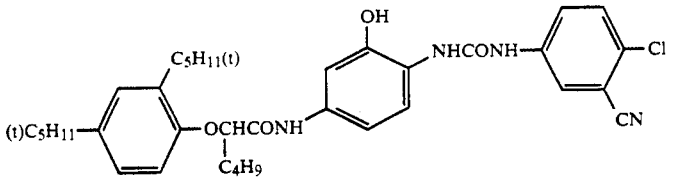
C4-21
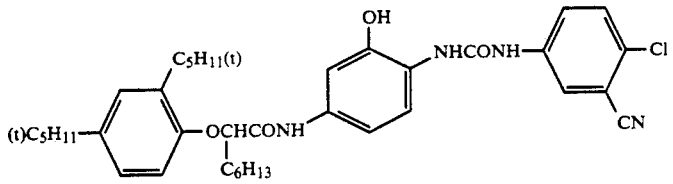
C4-22
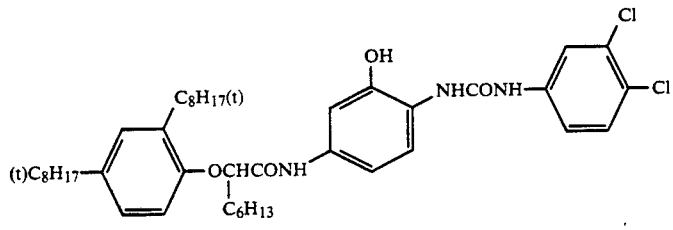
C4-23
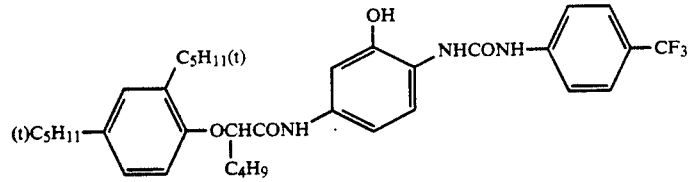
C4-24
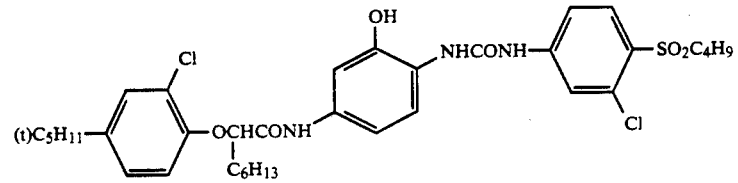
C4-25
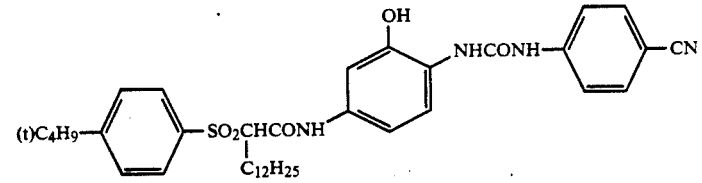
C4-26
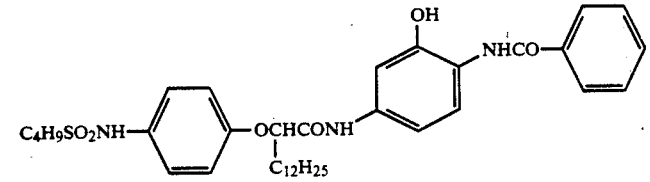
C4-27
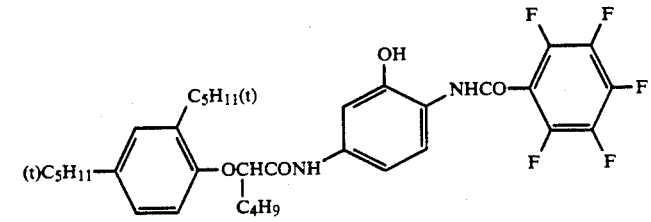

-continued

C4-28

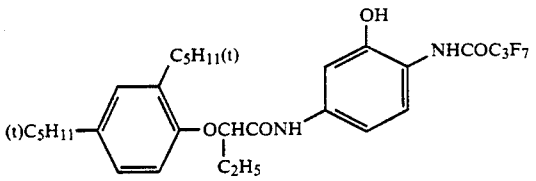

C4-29

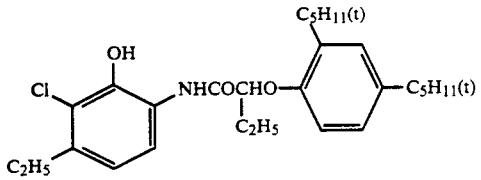

C4-30

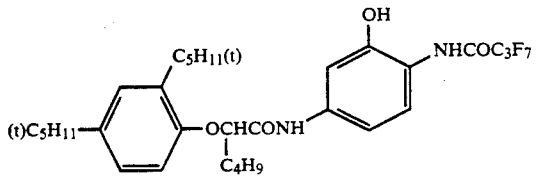

C4-31

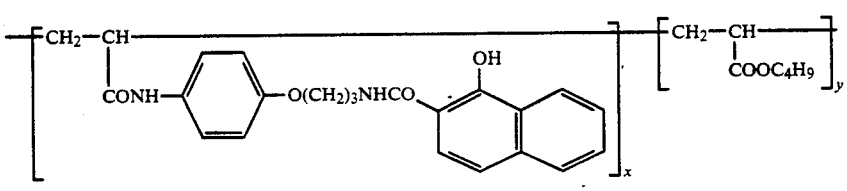

x:y = 40:60 (ratio by weight)

C4-32

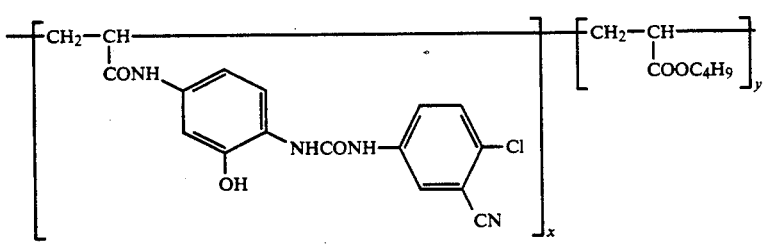

x:y = 50:50 (ratio by weight)

Furthermore, to make the relationship of the maximum sensitivities $SR_{max}$ and $SB_{max}$ of the red-sensitive and blue-sensitive layer in the wavelength band between 400 nm and 480 nm satisfy the requirement of the present invention, what is called a diffusive DIR coupler may be used in the blue-sensitive layer. The diffusive DIR couplers listed below are included in the concept of the cyan coupler described above in a broader sense.

Examples of diffusive DIR couplers which can be used for the present invention are given below, but these are not to be construed as limitative.

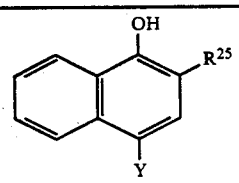

| Example compound number | $R^{25}$ | Y |
|---|---|---|
| $C_D$-1 | (1) | (6) |
| $C_D$-2 | (1) | (7) |

-continued

| | | |
|---|---|---|
| $C_D$-3 | (2) | (8) |
| $C_D$-4 | (4) | (9) |
| $C_D$-5 | (2) | (10) |
| $C_D$-6 | (2) | (11) |
| $C_D$-7 | (2) | (12) |
| $C_D$-8 | (2) | (13) |
| $C_D$-9 | (3) | (14) |
| $C_D$-10 | (5) | (15) |
| $C_D$-11 | (5) | (16) |
| $C_D$-12 | (2) | (17) |
| $C_D$-13 | (2) | (18) |

(1) $-CONHC_{18}H_{37}$, (2) 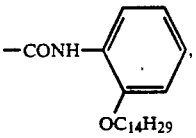 , (3) 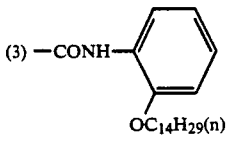 ,

-continued
(4) 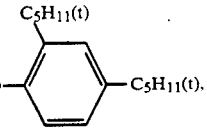
(5) 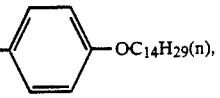
(6) 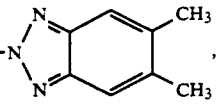
(7) 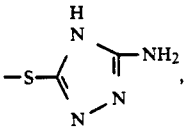
(8) 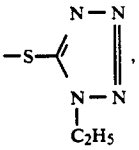
(9) 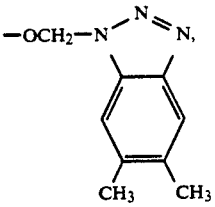
(10) 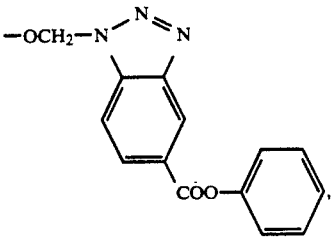
(11) 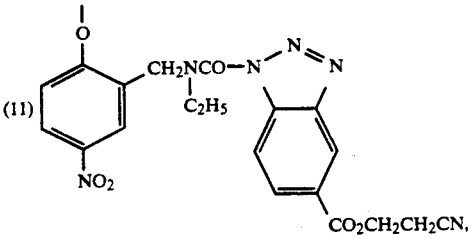
-continued
(12) 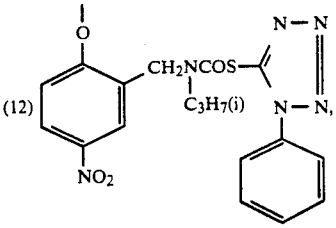
(13) 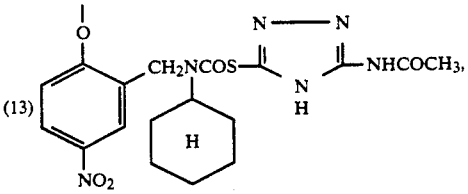
(14) 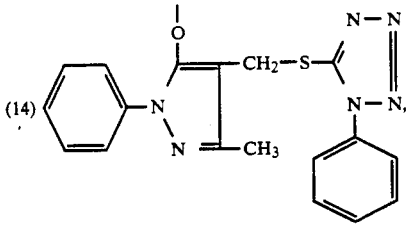
(15) 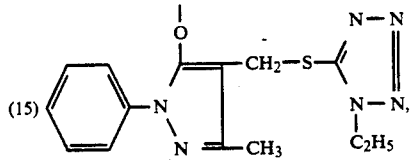
(16) 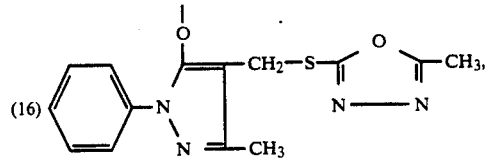
(17) 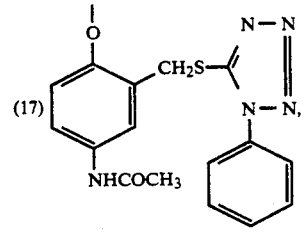
(18) 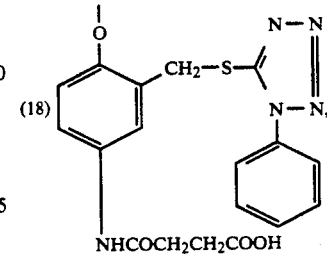

Of the couplers described above, diffusive DIR couplers are desirable as additives to the blue-sensitive layer.

There is no particular limitation on the amount of coupler added; an appropriate amount may be contained so that the maximum sensitivity relationship falls in the range for the present invention.

The silver halide emulsion used in the color photographic light-sensitive material of the present invention may be chemically sensitized by an ordinary method.

The silver halide emulsion may be formulated with an antifogging agent, a stabilizer and other additives. It is advantageous to use gelatin as the binder for the emulsion, though this is not to be construed as limitative.

The emulsion layer and other hydrophilic colloidal layers may be hardened, and may also contain a plasticizer, a water-insoluble or sparingly soluble synthetic polymer dispersion (latex).

The present invention is preferably applied to color negative films, color reversal films and so on.

The emulsion layer of the color photographic light-sensitive material of the present invention generally incorporates a color developing coupler.

It is also possible to use a colored coupler and competitive coupler having a corrective effect, and a chemical substance which couples with the oxidation product of the developing agent and releases a photographically useful fragment such as a development accelerator, a bleach accelerator, a developer, a silver halide solvent, a toning agent, a hardener, a fogging agent, an antifogging agent, a chemical sensitizer, a spectral sensitizer and a desensitizer.

The light-sensitive material may be provided with an auxiliary layer such as a filter layer, an anti-halation layer or an anti-irradiation layer. In these layers and/or emulsion layer, a dye may be contained which elutes from the light-sensitive material or is bleached during the developing process.

The light-sensitive material may be supplemented with a formalin scavenger, a brightener, a matting agent, a lubricant, an image stabilizer, a surfactant, an anti-stain agent, a development accelerator, a development retarder and a bleach accelerator.

Any substance can be used as the support such as polyethylene laminated paper, polyethylene terephthalate films, baryta paper and cellulose triacetate.

A dye image can be obtained using the color photographic light-sensitive material of the present invention by carrying out an ordinary known color photographic process after exposure.

EXAMPLES

The present invention is hereinafter described in more detail by means of the following examples, but the modes of embodiment of the present invention are not limited to these examples.

In all the following examples, the amount of addition to the silver halide photographic light-sensitive material is expressed in gram per $m^2$, unless otherwise specified. Also, the amount of silver halide and colloidal silver is expressed on the basis of the amount of silver.

EXAMPLE 1

Layers having the following compositions were formed on a triacetyl cellulose film support in this order from the support side to yield a multiple layer color photographic light-sensitive material sample No. 101.

Sample No. 101

| | |
|---|---|
| Layer 1: Anti-halation layer HC-1 | |
| Black colloidal silver | 0.20 |
| UV absorbent UV-1 | 0.20 |
| High boiling solvent Oil-1 | 0.20 |
| Gelatin | 1.5 |
| Layer 2: Interlayer IL-1 | |
| UV absorbent UV-1 | 0.04 |
| High boiling solvent Oil-1 | 0.04 |
| Gelatin | 1.2 |
| Layer 3: Low speed red-sensitive emulsion layer RL | |
| Silver iodobromide emulsion Em-1 | 0.6 |
| Silver iodobromide emulsion Em-2 | 0.2 |
| Sensitizing dye III-11 | $2.2 \times 10^{-4}$ (mol/mol silver) |
| Sensitizing dye I-6 | $2.2 \times 10^{-4}$ (mol/mol silver) |
| Sensitizing dye I-34 | $0.44 \times 10^{-4}$ (mol/mol silver) |
| Cyan coupler $C_4$-20 | 0.65 |
| Colored cyan coupler CC-1 | 0.12 |
| DIR compound $C_D$-9 | 0.004 |
| DIR compound $C_D$-11 | 0.013 |
| High boiling solvent Oil-1 | 0.6 |
| Gelatin | 1.5 |
| Layer 4: High speed red-sensitive emulsion layer RH | |
| Silver iodobromide emulsion Em-3 | 0.8 |
| Sensitizing dye III-11 | $1.2 \times 10^{-4}$ (mol/mol silver) |
| Sensitizing dye I-6 | $1.2 \times 10^{-4}$ (mol/mol silver) |
| Sensitizing dye I-34 | $0.1 \times 10^{-4}$ (mol/mol silver) |
| Cyan coupler $C_2$-29 | 0.16 |
| Cyan coupler $C_2$-8 | 0.02 |
| Colored cyan coupler CC-1 | 0.03 |
| DIR compound $C_P$-11 | 0.016 |
| High boiling solvent Oil-1 | 0.2 |
| Gelatin | 1.3 |
| Layer 5: Interlayer IL-2 | 0.7 |
| Gelatin | |
| Layer 6: Low speed green-sensitive emulsion layer GL | |
| Silver iodobromide emulsion Em-1 | 0.8 |
| Sensitizing dye OD-1 | $3.0 \times 10^{-4}$ (mol/mol silver) |
| Sensitizing dye OD-2 | $5.0 \times 10^{-4}$ (mol/mol silver) |
| Magenta coupler M-1 | 0.2 |
| Magenta coupler M-2 | 0.2 |
| Colored magenta coupler CM-1 | 0.1 |
| DIR compound D-1 | 0.02 |
| DIR compound D-2 | 0.004 |
| High boiling solvent Oil-2 | 0.4 |
| Gelatin | 1.0 |
| Layer 7: High speed green-sensitive emulsion layer GH | |
| Silver iodobromide emulsion Em-3 | 0.9 |
| Sensitizing dye OD-1 | $1.5 \times 10^{-4}$ (mol/mol silver) |
| Sensitizing dye OD-2 | $2.5 \times 10^{-4}$ (mol/mol silver) |
| Sensitizing dye OD-12 | $0.55 \times 10^{-4}$ (mol/mol silver) |
| Magenta coupler M-2 | 0.09 |
| Colored magenta coupler CM-2 | 0.04 |
| DIR compound D-1 | 0.006 |
| High boiling solvent Oil-2 | 0.3 |
| Gelatin | 1.0 |
| Layer 8: Yellow filter layer YC | |
| Yellow colloidal silver | 0.1 |
| Anti-color staining agent SC-1 | 0.1 |
| High boiling solvent Oil-3 | 0.1 |
| Gelatin | 0.8 |
| Layer 9: Low speed blue-sensitive emulsion layer BL | |
| Silver iodobromide emulsion Em-4 | 0.35 |

-continued

| | |
|---|---|
| Silver iodobromide emulsion Em-2 | 0.10 |
| Sensitizing dye SD-2 | $0.6 \times 10^{-3}$ (mol/mol silver) |
| Yellow coupler Y-1 | 0.6 |
| Yellow coupler Y-2 | 0.1 |
| DIR compound $C_D$-11 | 0.01 |
| High boiling solvent Oil-3 | 0.3 |
| Gelatin | 1.0 |
| Layer 10: High speed blue-sensitive emulsion layer BH | |
| Silver iodobromide emulsion Em-5 | 0.4 |
| Silver iodobromide emulsion Em-4 | 0.1 |
| Sensitizing dye SD-1 | $1 \times 10^{-4}$ (mol/mol silver) |
| Sensitizing dye SD-2 | $0.3 \times 10^{-3}$ (mol/mol silver) |
| Yellow coupler Y-1 | 0.20 |
| Yellow coupler Y-2 | 0.03 |
| High boiling solvent Oil-3 | 0.07 |
| Gelatin | 1.1 |
| Layer 11: First protective layer PRO-1 | |
| Fine grains of silver iodobromide emulsion (average grain size 0.08 μm, AgI content 2 mol %) | 0.2 |
| UV absorbent UV-1 | 0.10 |
| UV absorbent UV-2 | 0.05 |
| High boiling solvent Oil-1 | 0.1 |
| High boiling solvent Oil-4 | 0.1 |
| Formalin scavenger HS-1 | 0.5 |
| Formalin scavenger HS-2 | 0.2 |
| Gelatin | 1.0 |
| Layer 12: Second protective layer PRO-2 | |
| Surfactant SU-1 | 0.005 |
| Alkali-soluble matting agent (average grain size 2 μm) | 0.05 |
| Polymethyl methacrylate (average grain size 3 μm) | 0.05 |
| Lubricant WAX-1 | 0.04 |
| Gelatin | 0.5 |

In addition to these compositions, a coating aid Su-2, dispersing agents Su-3 and Su-4, hardeners H-1 and H-2, a stabilizer ST-1, an antifogging agent AF-1 and two kinds of AF-2 having an average molecular weight of 10,000 or 1,100,000, respectively, were added.

The emulsions used to prepare the samples described above are as follows:

Em-1

Monodispersed (distribution width 18%) core/shell type silver iodobromide emulsion grains having an average grain size of 0.45 μm, an average silver iodide content of 6.0 mol % and an outer phase silver iodide content of 2 mol %. Distribution width=standard deviation/average grain size×100

Em-2

Monodispersed (distribution width 18%) core/shell type silver iodobromide emulsion grains having an average grain size of 0.25 μm, an average silver iodide content of 6.0 mol % and an outer phase silver iodide content of 0.5 mol %.

Em-3

Monodispersed (distribution with 16%) core/shell type silver iodobromide emulsion grains having an average grain size of 0.80 μm, an average silver iodide content of 7.0 mol % and an outer phase silver iodide content of 1.0 mol %.

Em-4

Monodispersed (distribution width 17%) core/shell type silver iodobromide emulsion grains having an average grain size of 0.50 μm, an average silver iodide content of 6.0 mol % and an outer phase silver iodide content of 1.5 mol %.

Em-5

Monodispersed (distribution width 16%) core/shell type silver iodobromide emulsion grains having an average grain size of 0.90 μm, an average silver iodide content of 6.0 mol % and an outer phase silver iodide content of 1.0 mol %.

The compounds used to prepare the samples described above are as follows:

SD-1

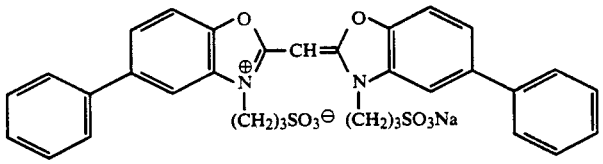

SD-2

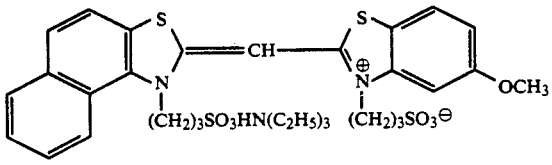

M-1

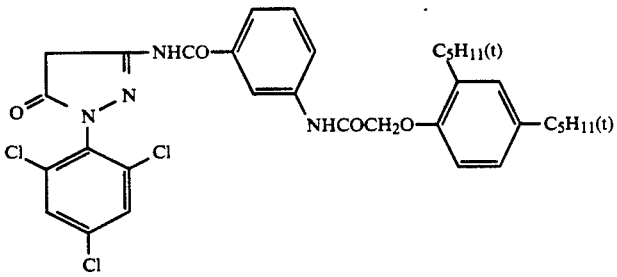

-continued
M-2
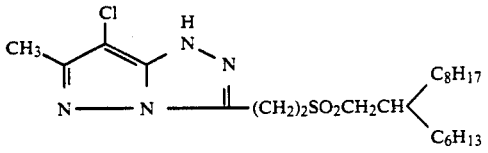
Y-1
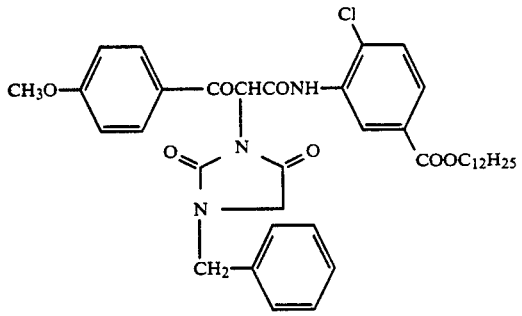
Y-2
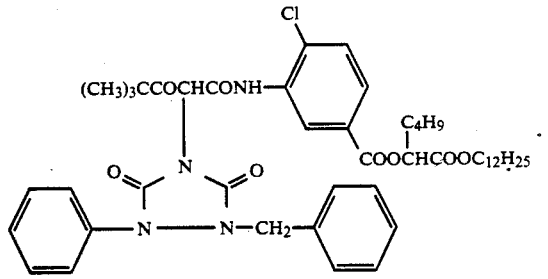
CC-1
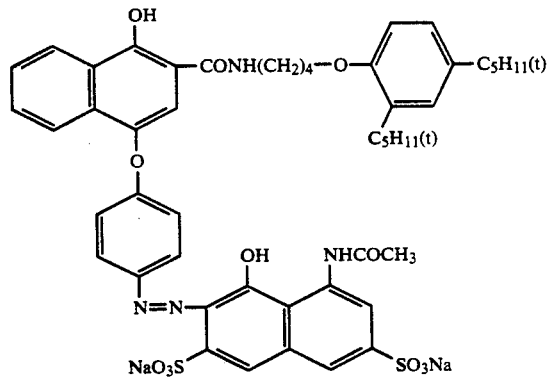
CM-1
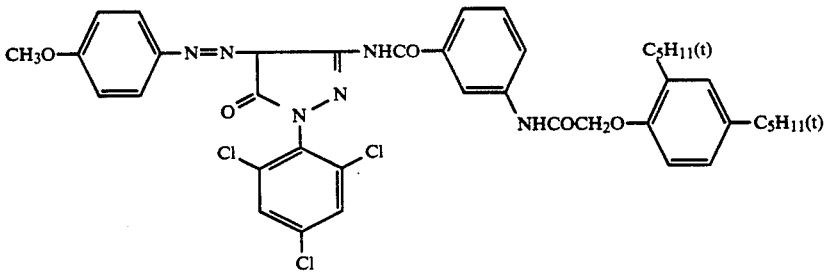

-continued
CM-2
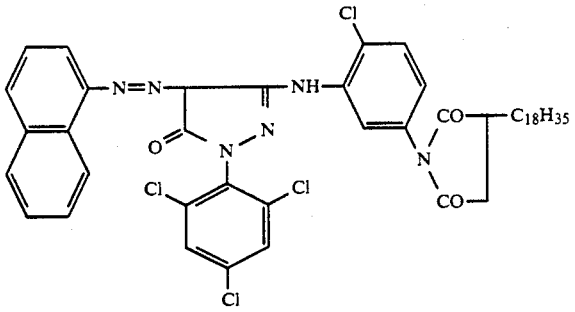
D-1
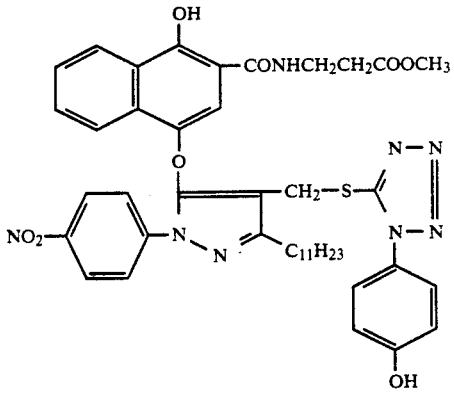
D-2
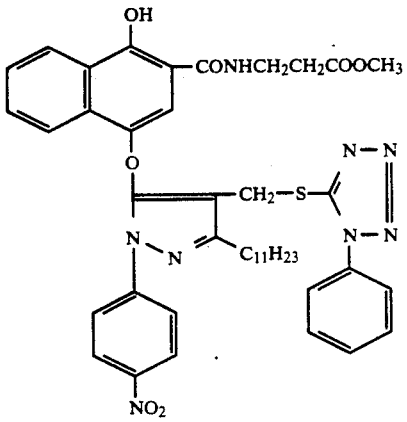
UV-1
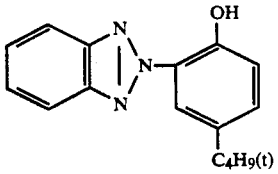
UV-2
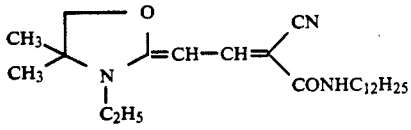
HS-1
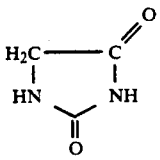

-continued
HS-2
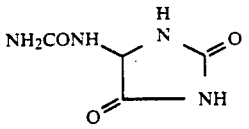
H-1
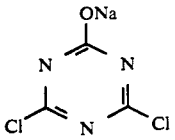
H-2
$(CH_2{=}CHSO_2CH_2)_2O$
Su-1
$NaO_3S{-}CHCOOCH_2(CF_2CF_2)_3H$
$\quad\quad\quad\quad | $
$\quad\quad\quad CH_2COOCH_2(CF_2CF_2)_3H$
Su-2
$NaO_3S{-}CHCOOC_8H_{17}$
$\quad\quad\quad\quad | $
$\quad\quad\quad CH_2COOC_8H_{17}$
Su-3
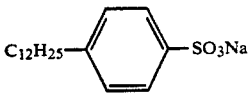
Su-4
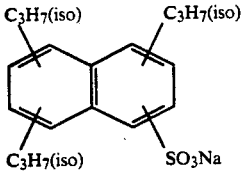
SC-1
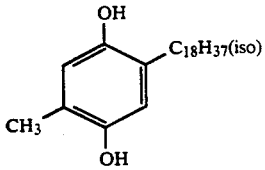
WAX-1
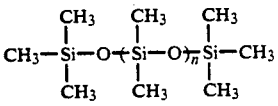
Weight average molecular weight Mw = 3,000
Oil-1
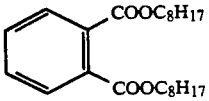
Oil-2
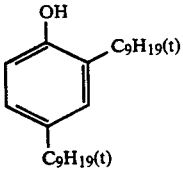
Oil-3
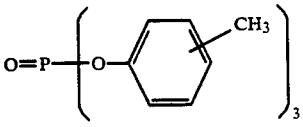

-continued

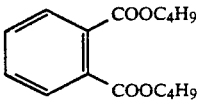

Oil-4

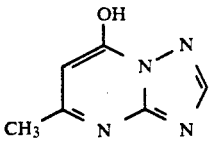

ST-1

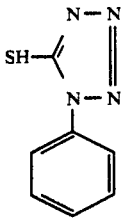

AF-1

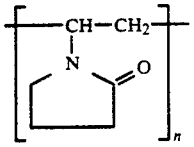

n: Degree of polymerization

AF-2

Sample Nos. 102 through 111 were prepared in the same manner as with sample No. 101 except that the sensitizing dyes for layers 3 and 4 and those for layers 9 and 10 were replaced with other sensitizing dyes as shown in Table 1.

TABLE 1

| | Layer 3 | | Layer 4 | | Layer 9 | | Layer 10 | |
|---|---|---|---|---|---|---|---|---|
| Sample No. | Dye number | Amount (mol/AgI mol) × $10^{-4}$ | Dye number | Amount (mol/AgI mol) × $10^{-4}$ | Dye number | Amount (mol/AgI mol) × $10^{-4}$ | Dye number | Amount (mol/AgI mol) × $10^{-4}$ |
| 101 | (I-34) | 0.44 | (I-34) | 0.1 | (SD-2) | 6.0 | (SD-1) | 1.0 |
| | (I-6) | 2.2 | (I-6) | 1.2 | | | (SD-2) | 3.0 |
| | (III-11) | 2.2 | (III-11) | 1.2 | | | | |
| 102 | (I-34) | 0.44 | (I-34) | 0.1 | (SS-1) | 2.4 | (SD-1) | 0.4 |
| | (I-6) | 2.2 | (I-6) | 1.2 | | | (SS-1) | 1.2 |
| | (III-11) | 2.2 | (III-11) | 1.2 | | | | |
| 103 | (I-34) | 0.44 | (I-34) | 0.1 | (SD-2) | 6.0 | (SD-1) | 1.0 |
| | (I-6) | 4.4 | (I-6) | 2.4 | | | (SD-2) | 3.0 |
| 104 | (II-5) | 2.4 | (II-5) | 1.2 | (SS-1) | 2.4 | (SD-1) | 0.4 |
| | (III-11) | 2.45 | (III-11) | 1.3 | | | (SS-1) | 1.2 |
| 105 | (I-34) | 0.20 | (I-34) | 0.1 | (SD-2) | 6.0 | (SD-1) | 1.0 |
| | (I-6) | 0.65 | (I-6) | 0.4 | | | (SD-2) | 3.0 |
| | (III-11) | 4.0 | (III-11) | 2.0 | | | | |
| 106 | (I-34) | 0.20 | (I-34) | 0.1 | (SS-1) | 2.4 | (SD-1) | 0.4 |
| | (I-6) | 0.65 | (I-6) | 0.4 | | | (SS-1) | 1.2 |
| | (III-11) | 4.0 | (III-11) | 2.0 | | | | |
| 107 | (I-6) | 1.0 | (I-6) | 0.5 | (SS-1) | 2.4 | (SD-1) | 0.4 |
| | (II-5) | 3.85 | (II-5) | 2.0 | | | (SS-1) | 1.2 |
| 108 | (I-6) | 1.0 | (I-6) | 0.5 | (SS-1) | 2.4 | (SD-1) | 0.4 |
| | (III-8) | 3.85 | (III-8) | 2.0 | | | (SS-1) | 1.2 |
| 109 | (I-6) | 1.0 | (I-6) | 0.5 | (SS-1) | 2.4 | (SD-1) | 0.4 |
| | (II-5) | 1.9 | (II-5) | 1.0 | | | (SS-1) | 1.2 |
| | (III-11) | 1.95 | (III-11) | 1.0 | | | | |
| 110 | (I-6) | 1.0 | (I-6) | 0.5 | (SS-5) | 2.4 | (SD-1) | 0.4 |
| | (II-5) | 3.85 | (II-5) | 2.0 | | | (SS-5) | 1.2 |
| 111 | (I-6) | 1.0 | (I-6) | 0.5 | No dye | | No dye | |
| | (II-5) | 3.85 | (II-5) | 2.0 | | | | |

Using sample Nos. 101 through 111 thus prepared, photographs of a Macbeth color rendition chart were taken, followed by the developing process shown below.

| | |
|---|---|
| Color development | 3 minutes 15 seconds |
| Bleaching | 6 minutes 30 seconds |
| Washing | 3 minutes 15 seconds |
| Fixation | 6 minutes 30 seconds |
| Washing | 3 minutes 15 seconds |
| Stabilization | 1 minute 30 seconds |

The processing solutions used in the respective processing procedures had the following compositions:

Color Developer

| | |
|---|---|
| 4-amino-3-methyl-N-ethyl-N-(β-hydroxyethyl) aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate monohydrate | 2.5 g |
| Potassium hydroxide | 1.0 g |

Water was added to make a total quantity of 1l (pH=10.1)

Bleacher

| | |
|---|---|
| Iron (III) ammonium ethylenediaminetetra-acetate | 100 g |
| Diammonium ethylenediaminetetraacetate | 10.0 g |
| Ammonium bromide | 150.0 g |
| Glacial acetic acid | 10 ml |

Water was added to make a total quantity of 1l, and aqueous ammonia was added to obtain a pH of 6.0.

Fixer

| | |
|---|---|
| Ammonium thiosulfate | 175.0 g |
| Anhydrous sodium sulfite | 8.5 g |
| Sodium metasulfite | 2.3 g |

Water was added to make a total quantity of 1l, and acetic acid was added to obtain a pH of 6.0.

Stabilizer

| | |
|---|---|
| Formalin (37% aqueous solution) | 1.5 ml |
| Konidax (produced by Konica Corporation) | 7.5 ml |
| Water was added to make a total quantity of 1 l. | |

From the developed films thus obtained, images were printed on color paper (Konica Color PC Paper type SR) so that gray of an optical density of 0.7 was reproduced into the same density. Each reproduced color was subjected to colorimetry using a color analyzer (CMS-1200, produced by Murakami Shikisai Sha). Results are shown in FIG. 1 using the L*a*b* color system. The wavelengths which provided the maximum spectral sensitivity for the blue- and red-sensitive layers of each sample are shown in Table 2.

Also, sample Nos. 101 through 111 were exposed to white light through an optical wedge, followed by the same developing process as above.

The sensitivity of the red-sensitive layer of sample Nos. 101 through 111 thus processed was determined. Results are shown in Table 2. Here, the sensitivity is obtained from the amount of exposure necessary to provide an optical density of minimum density+0.3 as obtained by densitometry through a red filter, expressed in percent ratio relative to the sensitivity of sample No. 101.

In FIG. 1, wherein numbers 1 through 11 correspond sample Nos. 101 through 111, respectively, the samples plotted on the line connecting the original color point (marked with o) and the starting point had the same hue as of the original.

As seen in FIG. 1, with respect to the samples prepared in accordance with the present invention, the reproduced color points for purple (P), bluish purple (BP), bluish green (BG) and green (G) colors are near the original point, demonstrating that exact hue reproduction has been achieved.

TABLE 2

| Sample number | Maximum sensitivity wavelength [nm] Blue-sensitive layer | Red-sensitive layer | Relative sensitivity of red-sensitive layer (%) |
|---|---|---|---|
| 101 | 480 | 635 | 100 |
| 102 | 470 | 635 | 100 |
| 103 | 480 | 645 | 100 |
| 104 | 470 | 580 | 70 |
| 105 | 480 | 615 | 100 |
| 106 | 470 | 615 | 100 |
| 107 | 470 | 610 | 120 |
| 108 | 470 | 615 | 110 |
| 109 | 470 | 610 | 115 |
| 110 | 465 | 610 | 120 |
| 111 | 430 | 610 | 120 |

As is evident from Table 2, the sensitivity of the red-sensitive layer has not been degraded in the samples prepared in accordance with the present invention.

The sensitivity of the blue-sensitive layer of sample Nos. 101, 106 and 111 at λ=480 nm had the following relative values (%) relative to the respective maximum sensitivities.

TABLE 2a

| Sample number (inventive/comparative) | Percent ratio (%) |
|---|---|
| 101 (comparative) | 100 |
| 106 (Inventive) | 42 |
| 111 (Inventive) | 32 |

This data shows that bluish green color reproduction is improved as the relative sensitivity at a wavelength of 480 nm decreases.

EXAMPLE 2

Layers having the following compositions were formed on a triacetyl cellulose film support in this order from the support side in the same manner as in Example 1 to yield a multiple layer color photographic light-sensitive material sample No. 201. Sample Nos. 202 through 205 were also prepared as described below.

Sample No. 201

| | |
|---|---|
| Layer 1: Anti-halation layer HC-1 | |
| Black colloidal silver | 0.20 |
| UV absorbent UV-1 | 0.20 |
| High boiling solvent Oil-1 | 0.20 |
| Gelatin | 1.5 |
| Layer 2: Interlayer IL-1 | |
| UV absorbent UV-1 | 0.04 |
| High boiling solvent Oil-1 | 0.04 |
| Gelatin | 1.2 |
| Layer 3: Low speed red-sensitive emulsion layer RL | |
| Silver iodobromide emulsion Em-6 | 0.6 |
| Silver iodobromide emulsion Em-7 | 0.2 |
| Sensitizing dye III-11 | $1.9 \times 10^{-4}$ (mol/mol silver) |
| Sensitizing dye I-6 | $1.0 \times 10^{-4}$ (mol/mol silver) |
| Sensitizing dye II-5 | $1.9 \times 10^{-4}$ (mol/mol silver) |
| Cyan coupler $C_4$-20 | 0.65 |
| Colored cyan coupler CC-1 | 0.12 |
| DIR compound $C_D$-9 | 0.004 |
| DIR compound $C_D$-11 | 0.013 |

-continued

| | |
|---|---|
| High boiling solvent Oil-1 | 0.6 |
| Gelatin | 1.5 |
| Layer 4: High speed red-sensitive emulsion layer RH | |
| Silver iodobromide emulsion Em-8 | 0.8 |
| Sensitizing dye III-11 | $1.0 \times 10^{-4}$ (mol/mol silver) |
| Sensitizing dye I-6 | $0.5 \times 10^{-4}$ (mol/mol silver) |
| Sensitizing dye II-5 | $1.0 \times 10^{-4}$ (mol/mol silver) |
| Cyan coupler $C_2$-29 | 0.16 |
| Cyan coupler $C_2$-8 | 0.02 |
| Colored cyan coupler CC-1 | 0.03 |
| DIR compound $C_D$-11 | 0.016 |
| High boiling solvent Oil-1 | 0.2 |
| Gelatin | 1.3 |
| Layer 5: Interlayer IL-2 | 0.7 |
| Gelatin | |
| Layer 6: Low speed green-sensitive emulsion layer GL | |
| Silver iodobromide emulsion Em-6 | 0.8 |
| Sensitizing dye OD-1 | $3.0 \times 10^{-4}$ (mol/mol silver) |
| Sensitizing dye OD-2 | $5.0 \times 10^{-4}$ (mol/mol silver) |
| Magenta coupler M-1 | 0.2 |
| Magenta coupler M-2 | 0.2 |
| Colored magenta coupler CM-1 | 0.1 |
| DIR compound D-1 | 0.02 |
| DIR compound D-2 | 0.004 |
| High boiling solvent Oil-2 | 0.4 |
| Gelatin | 1.0 |
| Layer 7: High speed green-sensitive emulsion layer GH | |
| Silver iodobromide emulsion Em-8 | 0.9 |
| Sensitizing dye OD-1 | $1.5 \times 10^{-4}$ (mol/mol silver) |
| Sensitizing dye OD-2 | $2.5 \times 10^{-4}$ (mol/mol silver) |
| Magenta coupler M-2 | 0.09 |
| Colored magenta coupler CM-2 | 0.04 |
| DIR compound D-1 | 0.006 |
| High boiling solvent Oil-2 | 0.3 |
| Gelatin | 1.0 |
| Layer 8: Yellow filter layer YC | |
| Yellow colloidal silver | 0.1 |
| Anti-color staining agent SC-1 | 0.1 |
| High boiling solvent Oil-3 | 0.1 |
| Gelatin | 0.8 |
| Layer 9: Low speed blue-sensitive emulsion layer BL | |
| Silver iodobromide emulsion Em-6 | 0.35 |
| Silver iodobromide emulsion Em-7 | 0.10 |
| Sensitizing dye SD-2 | $0.6 \times 10^{-3}$ (mol/mol silver) |
| Yellow coupler Y-1 | 0.6 |
| Yellow coupler Y-2 | 0.1 |
| DIR compound $C_D$-11 | 0.01 |
| High boiling solvent Oil-3 | 0.3 |
| Gelatin | 1.0 |
| Layer 10: High speed blue-sensitive emulsion layer BH | |
| Silver iodobromide emulsion Em-8 | 0.4 |
| Silver iodobromide emulsion Em-6 | 0.1 |
| Sensitizing dye SD-1 | $1 \times 10^{-4}$ (mol/mol silver) |
| Sensitizing dye SD-2 | $0.3 \times 10^{-3}$ (mol/mol silver) |
| Yellow coupler Y-1 | 0.20 |
| Yellow coupler Y-2 | 0.03 |
| High boiling solvent Oil-3 | 0.07 |
| Gelatin | 1.1 |
| Layer 11: First protective layer PRO-1 | |
| Fine grains of silver iodobromide emulsion (average grain size 0.08 μm, AgI content 2 mol %) | 0.2 |
| UV absorbent UV-1 | 0.10 |
| UV absorbent UV-2 | 0.05 |
| High boiling solvent Oil-1 | 0.1 |

-continued

| | |
|---|---|
| High boiling solvent Oil-4 | 0.1 |
| Formalin scavenger HS-1 | 0.5 |
| Formalin scavenger HS-2 | 0.2 |
| Gelatin | 1.0 |
| Layer 12: Second protective layer PRO-2 | |
| Surfactant SU-1 | 0.005 |
| Alkali-soluble matting agent (average grain size 2 μm) | 0.05 |
| Polymethyl methacrylate (average grain size 3 μm) | 0.05 |
| Lubricant WAX-1 | 0.04 |
| Gelatin | 0.5 |

In addition to these compositions, a coating aid Su-2, dispersing agents Su-3 and Su-4, hardeners H-1 and H-2, a stabilizer ST-1, an antifogging agent AF-1 and two kinds of AF-2 having an average molecular weight of 10,000 or 1,100,000, respectively, were added.

The emulsions used to prepare the samples described above are as follows:

Em-6

A core/shell type monodispersed (distribution width 18%) silver iodobromide emulsion grains having an average grain size of 0.48 μm, an average silver iodide content of 6.0 mol % and outer phase silver iodide content of 1 mol %.

Em-7

A core/shell type monodispersed (distribution width 18%) silver iodobromide emulsion grains having an average grain size of 0.27 μm, an average silver iodide content of 6.0 mol % and outer phase silver iodide content of 0.5 mol %.

Em-8

A core/shell type monodispersed (distribution width 16%) silver iodobromide emulsion grains having an average grain size of 0.78 μm, an average silver iodide content of 7.0 mol % and outer phase silver iodide content of 1.0 mol %.

The compounds used in the samples described above were the same as in Example 1.

Sample No. 202

Sample No. 202 was prepared in the same manner as with sample No. 201 except that the following modifications were made.

The sensitizing dye SD-5 used in layers 9 and 10 was replaced with SS-5.

Sample No. 203

Sample No. 203 was prepared in the same manner as with sample No. 201 except that the following modifications were made.

(1) The sensitizing dyes for layer 6 were replaced with the following:

| | |
|---|---|
| Sensitizing dye (OD-1) | $1.0 \times 10^{-4}$ (mol/mol silver) |
| Sensitizing dye (OD-2) | $5.0 \times 10^{-4}$ (mol/mol silver) |
| Sensitizing dye (OD-20) | $2.0 \times 10^{-4}$ (mol/mol silver) |

(2) The sensitizing dyes for layer 7 were replaced with the following:

| | |
|---|---|
| Sensitizing dye (OD-1) | $0.5 \times 10^{-4}$ (mol/mol silver) |
| Sensitizing dye (OD-2) | $2.5 \times 10^{-4}$ (mol/mol silver) |
| Sensitizing dye (OD-20) | $1.0 \times 10^{-4}$ (mol/mol silver) |

Sample No. 204

Sample No. 204 was prepared in the same manner as with sample No. 203 except that the following modifications were made.

The sensitizing dye SD-2 used in layers 9 and 10 was replaced with SS-5.

Sample No. 205

Sample No. 205 was prepared in the same manner as with sample No. 203 except that the following modifications were made.

The sensitizing dye SS-5 used for layers 9 and 10 was not used.

Using sample Nos. 201 through 205 thus prepared, photographs of a Macbeth color rendition chart and a piece of bluish green cloth were taken at the same time, followed by the same developing process as in Example 1.

Figure 2:
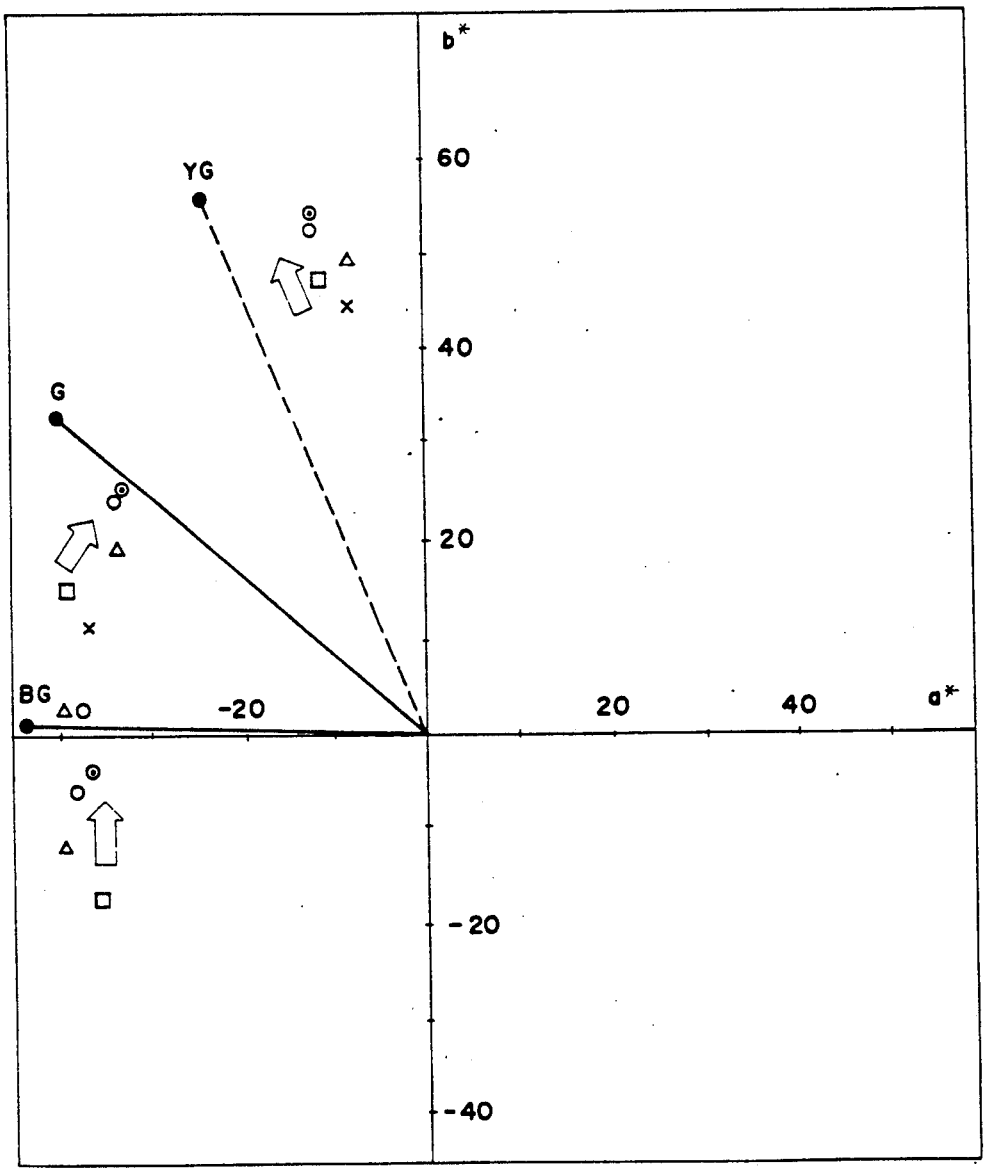

From the obtained films, color images were obtained by printing onto color paper (Konica Color PC Paper type SR) so that grey of an optical density of 0.7 was exactly reproduced into the same density. Of the reproduced colors, the bluish green (BG) color of the cloth, and the green (G) and yellowish green (YG) colors of the Macbeth color chart were subjected to colorimetry using a color analyzer (CMS-1200, produced by Murakami Shikisai Sha). Obtained results are shown in FIG. 2 using the L*a*b* color system, and summarized in Table 3. As seen in FIG. 2 and Table 3, the samples prepared in accordance with the present invention have proved excellent in color reproduction with improved hue reproducibility for bluish green and green and improved yellow color purity.

TABLE 3

| Sample number | $\lambda B_{max}$ (nm) | $SB_{max}/SB_{480}$ | $\lambda G_{max}$ (nm) | $SG_{500}/SG_{max}$ | Color reproduction (from FIG. 2) Bluish green cloth (BG) | Macbeth green (G) | Macbeth yellow (Y) |
|---|---|---|---|---|---|---|---|
| 201 | 475 | 1.4 | 555 | 1/6 | C | C | B |
| 202 | 450 | 2.5 | 555 | 1/6 | C | C | B |
| 203 | 475 | 1.4 | 546 | 1/3 | B | B | A |
| 204 | 450 | 2.5 | 546 | 1/3 | A | A | A |
| 205 | 440 | 4.0 | 546 | 1/3 | A | A | A |

#8 A: Good B: Poor C: Considerably poor

EXAMPLE 3

Layers having the following compositions were formed on a triacetyl cellulose film support in this order from the support side in the same manner as in Example 1 to yield a multiple layer color photographic light-sensitive material sample No. 301.

Sample No. 301

| | |
|---|---|
| Layer 1: Anti-halation layer HC-1 | |
| Black colloidal silver | 0.20 |
| UV absorbent UV-1 | 0.20 |
| High boiling solvent Oil-1 | 0.20 |
| Gelatin | 1.5 |

-continued

| | |
|---|---|
| Layer 2: Interlayer IL-1 | |
| UV absorbent UV-1 | 0.04 |
| High boiling solvent Oil-1 | 0.04 |
| Gelatin | 1.2 |
| Layer 3: Low speed red-sensitive emulsion layer RL | |
| Silver iodobromide emulsion Em-9 | 0.6 |
| Silver iodobromide emulsion Em-10 | 0.2 |
| Sensitizing dye III-11 | $2.2 \times 10^{-4}$ (mol/mol silver) |
| Sensitizing dye I-6 | $2.2 \times 10^{-4}$ (mol/mol silver) |
| Sensitizing dye I-34 | $0.44 \times 10^{-4}$ (mol/mol silver) |
| Cyan coupler $C_4$-20 | 0.65 |
| Colored cyan coupler CC-1 | 0.12 |
| DIR compound $C_D$-9 | 0.004 |
| DIR compound $C_D$-11 | 0.013 |
| High boiling solvent Oil-1 | 0.6 |
| Gelatin | 1.5 |
| Layer 4: High speed red-sensitive emulsion layer RH | |
| Silver iodobromide emulsion Em-11 | 0.8 |
| Sensitizing dye III-11 | $1.2 \times 10^{-4}$ (mol/mol silver) |
| Sensitizing dye I-6 | $1.2 \times 10^{-4}$ (mol/mol silver) |
| Sensitizing dye I-34 | $0.1 \times 10^{-4}$ (mol/mol silver) |
| Cyan coupler $C_2$-29 | 0.16 |
| Cyan coupler $C_2$-8 | 0.02 |
| Colored cyan coupler CC-1 | 0.03 |
| DIR compound $C_D$-11 | 0.016 |
| High boiling solvent Oil-1 | 0.2 |
| Gelatin | 1.3 |
| Layer 5: Interlayer IL-2 | 0.7 |
| Gelatin | |
| Layer 6: Low speed green-sensitive emulsion layer GL | |
| Silver iodobromide emulsion Em-9 | 0.8 |
| Sensitizing dye OD-1 | $3.0 \times 10^{-4}$ (mol/mol silver) |
| Sensitizing dye OD-2 | $5.0 \times 10^{-4}$ (mol/mol silver) |
| Magenta coupler M-1 | 0.2 |
| Magenta coupler M-2 | 0.2 |
| Colored magenta coupler CM-1 | 0.1 |
| DIR compound D-1 | 0.02 |
| DIR compound D-2 | 0.004 |
| High boiling solvent Oil-2 | 0.4 |
| Gelatin | 1.0 |
| Layer 7: High speed green-sensitive emulsion layer GH | |
| Silver iodobromide emulsion Em-11 | 0.9 |
| Sensitizing dye OD-1 | $1.5 \times 10^{-4}$ (mol/mol silver) |
| Sensitizing dye OD-2 | $2.5 \times 10^{-4}$ (mol/mol silver) |
| Sensitizing dye OD-12 | $0.55 \times 10^{-4}$ (mol/mol silver) |
| Magenta coupler M-2 | 0.09 |
| Colored magenta coupler CM-2 | 0.04 |
| DIR compound D-1 | 0.006 |
| High boiling solvent Oil-2 | 0.3 |
| Gelatin | 1.0 |
| Layer 8: Yellow filter layer YC | |
| Yellow colloidal silver | 0.1 |

-continued

| | |
|---|---|
| Anti-color staining agent SC-1 | 0.1 |
| High boiling solvent Oil-3 | 0.1 |
| Gelatin | 0.8 |
| Layer 9: Low speed blue-sensitive emulsion layer BL | |
| Silver iodobromide emulsion Em-9 | 0.35 |
| Silver iodobromide emulsion Em-10 | 0.10 |
| Sensitizing dye SD-2 | $0.6 \times 10^{-3}$ (mol/mol silver) |
| Yellow coupler Y-1 | 0.6 |
| Yellow coupler Y-2 | 0.1 |
| DIR compound $C_D$-11 | 0.01 |
| High boiling solvent Oil-3 | 0.3 |
| Gelatin | 1.0 |
| Layer 10: High speed blue-sensitive emulsion layer BH | |
| Silver iodobromide emulsion Em-11 | 0.4 |
| Silver iodobromide emulsion Em-1 | 0.1 |
| Sensitizing dye SD-1 | $1 \times 10^{-4}$ (mol/mol silver) |
| Sensitizing dye SD-2 | $0.3 \times 10^{-3}$ (mol/mol silver) |
| Yellow coupler Y-1 | 0.20 |
| Yellow coupler Y-2 | 0.03 |
| High boiling solvent Oil-3 | 0.07 |
| Gelatin | 1.1 |
| Layer 11: First protective layer PRO-1 | |
| Fine grains of silver iodobromide (average grain size 0.08 μm, AgI content 2 mol %) | 0.02 |
| UV absorbent UV-1 | 0.10 |
| UV absorbent UV-2 | 0.05 |
| High boiling solvent Oil-1 | 0.1 |
| High boiling solvent Oil-4 | 0.1 |
| Formalin scavenger HS-1 | 0.5 |
| Formalin scavenger HS-2 | 0.2 |
| Gelatin | 1.0 |
| Layer 12: Second protective layer PRO-2 | |
| Surfactant Su-1 | 0.005 |
| Alkali-soluble matting agent (average grain size 2 μm) | 0.05 |
| Polymethyl methacrylate (average grain size 3 μm) | 0.05 |
| Lubricant WAX-1 | 0.04 |
| Gelatin | 0.5 |

In addition to these compositions, a coating aid Su-2, dispersing agents Su-3 and Su-4, hardeners H-1 and H-2, a stabilizer ST-1, an antifogging agent AF-1 and two kinds of AF-2 having an average molecular weight of 10,000 or 1,100,000, respectively, were added.

The emulsions used to prepare the samples described above are as follows:

Em-9

A monodispersed (distribution width 18%) core/-shell type silver iodobromide emulsion having an average grain size of 0.45 μm, an average silver iodide content of 6.0 mol % and a silver iodide content relative standard deviation of 13%.

Em-10

A monodispersed (distribution width 18%) core/-shell type silver iodobromide emulsion having an average grain size of 0.25 μm, an average silver iodide content of 6.0 mol % and a silver iodobromide content relative standard deviation of 12%.

Em-11

A monodispersed (distribution width 16%) core/-shell type silver iodobromide emulsion having an average grain size of 0.80 μm, an average silver iodide content of 7.0 mol % and a silver iodide content relative standard deviation of 11%.

The compounds used in the samples described above were the same as in Example 1.

Next, sample Nos. 302 through 308 were prepared in the same manner as with the samples described above except that the compositions were changed as shown in Table 4. Specifically, for the low speed blue-sensitive layer (layer 9) and high speed blue-sensitive layer (layer 10) of the above sample No. 301, the silver iodobromide emulsion and sensitizing dyes were changed, and a cyan coupler listed in the table was added in addition to the yellow coupler. Also, the amounts of coating for the low speed red-sensitive layer (layer 3) and/or the high speed red-sensitive layer (layer 4) and/or the high speed green-sensitive layer (layer 7) were adjusted as necessary as shown in Table 4 according to the type and amount of the cyan coupler contained in layers 9 and 10.

The silver iodobromide emulsions Em-12 and Em-13 added to prepare sample Nos. 303 through 308 are as follows:

Em-12

A monodispersed (distribution width 17%) core/-shell type silver iodobromide emulsion having an average grain size of 0.50 μm, an average silver iodide content of 5.8 mol % and a silver iodide content relative standard deviation of 12%.

Em-13

A monodispersed (distribution width 16%) core/-shell type silver iodobromide emulsion having an average grain size of 0.90 μm, an average silver iodide content of 6.0 mol % and a silver iodide content relative standard deviation of 13%.

The sample Nos. 301 through 308 thus prepared were exposed to white light through an optical wedge, followed by the same color developing process as in Example 1. All samples gave similar sensitometric results.

Next, sample Nos. 301 through 308 were subjected to spectral exposure using several kinds of interference filters which are effective in the visible light band and then subjected to the same developing process as above. Then, the sensitivity which provided a density of minimum density+0.1 was determined for each sample, and a spectral sensitivity distribution over the entire visible light band was thus obtained. From this spectral sensitivity distribution were obtained the wavelength λ $B_{max}$ which provided the maximum sensitivity for the blue-sensitive emulsion layer, the ratio of the sensitivity SB(480 nm) of the blue-sensitive emulsion layer at a wavelength of 480 nm to the maximum sensitivity $SB_{max}$ of the blue-sensitive emulsion layer, and the ratio of the maximum sensitivity $SR_{max}$ of the red-sensitive emulsion layer to the maximum sensitivity $SB_{max}$ of the blue-sensitive emulsion layer in the wavelength band between 400 nm and 480 nm. Results are shown in Table 5 in percent ratio, i.e., $(SR_{max}/SB_{max}) \times 100$.

TABLE 4

| | Low speed blue-sensitive layer (layer 9) | | | |
|---|---|---|---|---|
| | | Sensitizing dye | | |
| Sample | Silver iodobromide emulsion | | Amount | Cyan colored coupler |

TABLE 4-continued

| number | Number | Amount | Number | (mol/mol silver) | Number | Amount |
|---|---|---|---|---|---|---|
| 301 | Em-9 | 0.35 | SD-2 | $0.60 \times 10^{-3}$ | $C_D$-11 | 0.01 |
| | Em-10 | 0.10 | | | | |
| 302 | Em-9 | 0.35 | SD-2 | $0.60 \times 10^{-3}$ | $C_4$-20 | 0.053 |
| | Em-10 | 0.10 | | | $C_D$-11 | 0.01 |
| 303 | Em-12 | 0.35 | SS-1 | $0.65 \times 10^{-3}$ | $C_D$-11 | 0.01 |
| | Em-10 | 0.10 | | | | |
| 304 | Em-12 | 0.35 | SS-1 | $0.65 \times 10^{-3}$ | $C_4$-20 | 0.053 |
| | Em-10 | 0.10 | | | $C_D$-11 | 0.01 |
| 305 | Em-12 | 0.35 | SS-2 | $0.63 \times 10^{-3}$ | $C_4$-20 | 0.053 |
| | Em-10 | 0.10 | | | $C_D$-11 | 0.01 |
| 306 | Em-12 | 0.35 | — | — | $C_4$-20 | 0.053 |
| | Em-10 | 0.10 | | | $C_D$-11 | 0.01 |
| 307 | Em-12 | 0.35 | SS-1 | $0.65 \times 10^{-3}$ | $C_4$-20 | 0.06 |
| | Em-10 | 0.10 | | | $C_D$-11 | 0.01 |
| 308 | Em-12 | 0.40 | SS-1 | $0.65 \times 10^{-3}$ | $C_D$-11 | 0.02 |
| | Em-10 | 0.10 | | | | |

| Sample number | High speed blue-sensitive layer (layer 10) Silver iodobromide emulsion Number | Amount | Sensitizing dye Kind | Amount (mol/mol silver) | Cyan coupler Number | Amount | Coating amount relative to sample No. 101 | Remark |
|---|---|---|---|---|---|---|---|---|
| 301 | Em-11 | 0.40 | SD-1 | $1.0 \times 10^{-4}$ | — | — | — | Comparative |
| | Em-9 | 0.10 | SD-2 | $0.30 \times 10^{-3}$ | | | | |
| 302 | Em-11 | 0.40 | SD-1 | $1.0 \times 10^{-4}$ | — | — | Layer 3 coating amount × 0.9 | Comparative |
| | Em-9 | 0.10 | SD-2 | $0.30 \times 10^{-3}$ | | | | |
| 303 | Em-13 | 0.45 | SD-1 | $1.0 \times 10^{-4}$ | — | — | — | Comparative |
| | Em-12 | 0.05 | SS-1 | $0.33 \times 10^{-3}$ | | | | |
| 304 | Em-13 | 0.45 | SD-1 | $1.0 \times 10^{-4}$ | — | — | Layer 3 coating amount × 0.9 | Inventive |
| | Em-12 | 0.05 | SS-1 | $0.33 \times 10^{-3}$ | | | | |
| 305 | Em-13 | 0.45 | SD-1 | $1.0 \times 10^{-4}$ | — | — | Layer 3 coating amount × 0.9 | Inventive |
| | Em-12 | 0.05 | SS-2 | $0.32 \times 10^{-3}$ | | | | |
| 306 | Em-13 | 0.45 | SD-1 | $2.5 \times 10^{-4}$ | — | — | Layer 3 coating amount × 0.9 | Inventive |
| | Em-12 | 0.05 | | | | | | |
| 307 | Em-13 | 0.45 | SD-1 | $1.0 \times 10^{-4}$ | $C_2$-29 | 0.03 | Layer 3 coating amount × 0.8 | Inventive |
| | Em-12 | 0.05 | SS-1 | $0.33 \times 10^{-3}$ | | | | |
| 308 | Em-13 | 0.60 | SD-1 | $1.0 \times 10^{-4}$ | $C_D$-11 | 0.03 | Layer 3 and 4 coating amounts × 0.9, layer 7 coating × 1.4 | Inventive |
| | Em-12 | 0.20 | SS-1 | $0.33 \times 10^{-3}$ | | | | |

TABLE 5

| Sample number | $\lambda B_{max}$ (nm) | SB (480 nm) $SB_{max}$ (%) | $SR_{max}/SB_{max}$ (%) between 400 nm and 480 nm |
|---|---|---|---|
| 301 | 480 | 100 | 1.0 |
| 302 | 480 | 100 | 2.7 |
| 303 | 465 | 60 | 1.0 |
| 304 | 465 | 60 | 2.7 |
| 305 | 463 | 56 | 2.7 |
| 306 | 430 | 45 | 2.7 |
| 307 | 465 | 60 | 4.0 |
| 308 | 465 | 60 | 2.8 |

After these samples were shaped so that they permitted picture taking using a camera, photographs were taken thereon of the BG (bluish green), G (green), YG (yellowish green), OR (orange) and BP (bluish purple) colors of a Macbeth color chart and of a piece of bluish green cloth. After picture taking, the developing process described above was carried out, and printing was conducted on Konica Color PC Paper type SR so that the grey color of a standard reflex plate whose photograph was taken at the same time was reproduced exactly.

Then, these colors on the prints were subjected to colorimetry using a color analyzer (CMS-1200, produced by Murakami Shikisai Sha) and the chromaticity points (light source C) for each color were plotted on the a*,b* chromaticity diagram. Results are shown in FIG. 3, wherein numbers 1 through 8 correspond to sample, Nos. 301 through 308, respectively.

Figure 3:
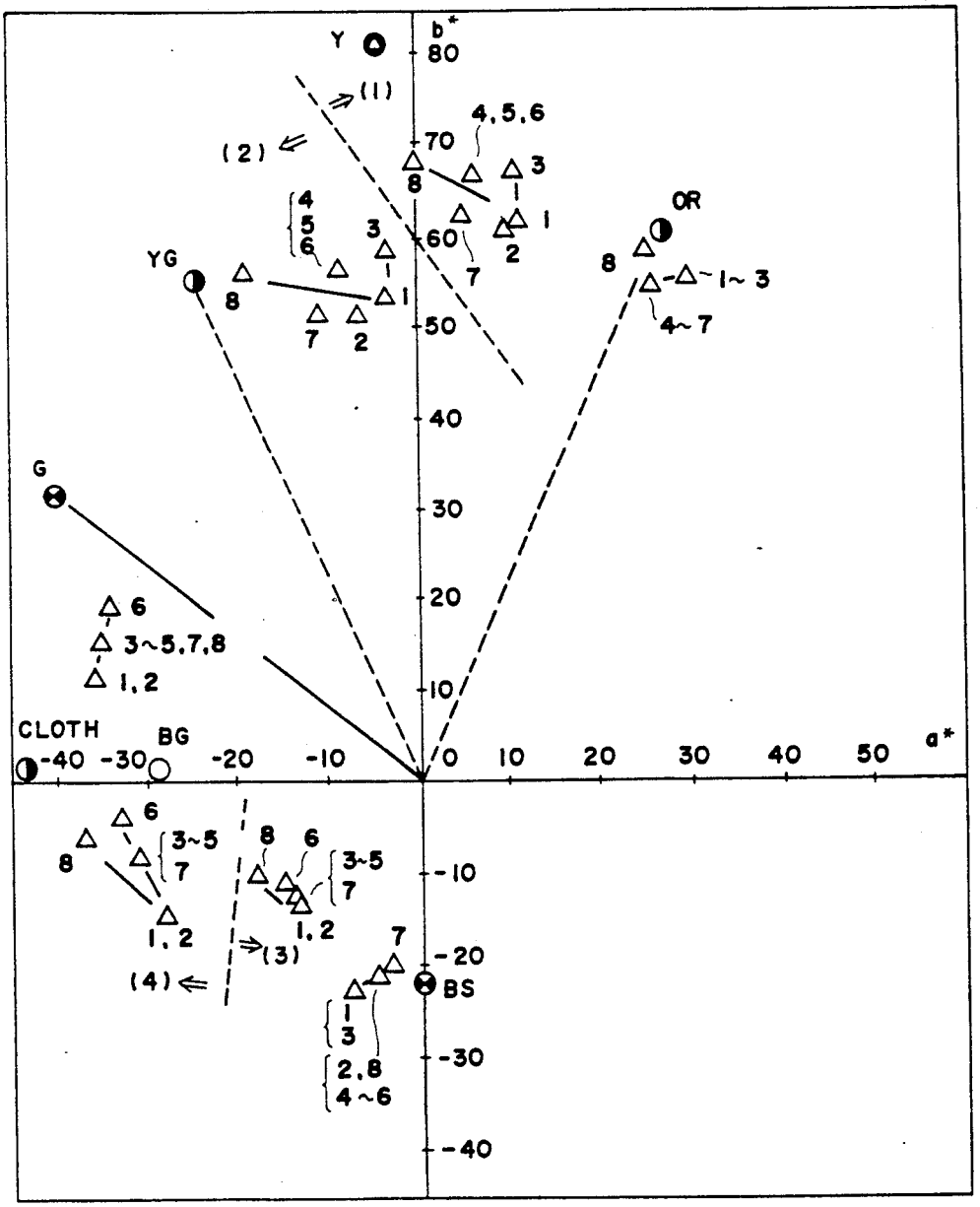

In FIG. 3, the samples plotted on the line connecting the original color point and the starting point had the same hue as of the original.

As seen in FIG. 3, with respect to sample Nos. 304 through 308 prepared in accordance with the present invention, the bluish green color of the cloth and the bluish green (BG) and green (G) colors of the Macbeth color chart were reproduced into almost the same hues as of the original colors, and the hues of the yellowish green (YG) and yellow (Y) colors were improved. On the other hand, none of the comparative sample Nos. 301 through 303 reproduced any of the bluish green color of the cloth, BG, G, YG and Y colors of the Macbeth color chart into nearly the same hues as of the original colors. Also, among the samples prepared in accordance with the present invention, sample No. 106 proved to have a noticeable effect on the bluish green cloth and BG and G, and sample Nos. 307 and 308 proved to have a noticeable effect on YG and Y. Above all, sample No. 308 showed an improvement in chromaticness for all colors examined, offering particularly good color reproduction.

It has also been found that with respect to the blue sky (BS) and orange (OR) hues of the Macbeth color chart, satisfactory improvements can be obtained with the constitution of the present invention, which has not been expected by the present inventors.

EXAMPLE 4

Sample Nos. 301 through 308 prepared in Example 3 were developed and evaluated in the same manner as in Example 3 except that the following developing conditions were used. Similar results were obtained.

| Processing procedure | Processing time | Processing temperature | Amount of replenisher |
|---|---|---|---|
| Color development | 3 min. 15 sec. | 38° | 540 ml |
| Bleaching | 45 sec. | 38° | 155 ml |
| Fixation | 1 min. 45 sec. | 38° | 500 ml |
| Stabilization | 90 sec. | 38° | 775 ml |
| Drying | 1 min. | 40–70° C. | — |

Note:
Figures for the amount of replenisher are values per $m^2$ light-sensitive material.

In the process, running was carried out until the replenisher was fed in an amount 3 times the capacity of the stabilization tank. Stabilization was conducted by the 3-vessel counter current method, wherein the replenisher was fed to the final stabilizer tank and the overflow solution flew into the tank before the final tank.

Also, a part (275 ml/$m^2$) of the overflow solution from the stabilization tank after the fixation tank was returned into the stabilization tank.

Composition of the Color Developer Used

| | |
|---|---|
| Potassium carbonate | 30 g |
| Sodium hydrogen carbonate | 2.7 g |
| Potassium sulfite | 2.8 g |
| Sodium bromide | 1.3 g |
| Hydroxylamine sulfate | 3.2 g |
| Sodium chloride | 0.6 g |
| 4-amino-3-methyl-N-ethyl-N-(β-hydroxylethyl) aniline sulfate | 4.6 g |
| Diethylenetriamine pentaacetate | 3.0 g |
| Potassium hydroxide | 1.3 g |

Water was added to reach a total quantity of 1l, and potassium hydroxide or 20% sulfuric acid was used to obtain a pH of 10.01.

Composition of the Color Developer Replenisher Used

| | |
|---|---|
| Potassium carbonate | 40 g |
| Sodium hydrogen carbonate | 3 g |
| Potassium sulfite | 7 g |
| Sodium bromide | 0.5 g |
| Hydroxylamine sulfate | 3.2 g |
| 4-amino-3-methyl-N-ethyl-N-(β-hydroxylethyl) aniline sulfate | 6.0 g |
| Diethylenetriamine pentaacetate | 3.0 g |
| Potassium hydroxide | 2 g |

Water was added to reach a total quantity of 1l, and potassium hydroxide or 20% sulfuric acid was used to obtain a pH of 10.12.

Composition of the Bleacher Used

| | |
|---|---|
| Ferric ammonium 1,3-diaminopropanetetraacetate | 0.35 mol |
| Disodium ethylenediaminetetraacetate | 2 g |
| Ammonium bromide | 150 g |
| Glacial acetic acid | 40 ml |
| Ammonium nitrate | 40 g |

Water was added to reach a total quantity of 1l, and aqueous ammonia or glacial acetic acid was used to obtain a pH of 4.5.

Composition of the Bleacher Replenisher Used

| | |
|---|---|
| Ferric ammonium 1,3-diaminopropanetetraacetate | 0.40 mol |
| Disodium ethylenediaminetetraacetate | 2 g |
| Ammonium bromide | 170 g |
| Ammonium nitrate | 50 g |
| Glacial acetic acid | 61 ml |

Water was added to reach a total quantity of 1l, and aqueous ammonia or glacial acetic acid was used to obtain a pH of 3.5, with proper adjustment made to maintain a given pH level of the bleacher tank solution.

Composition of the Fixer and Fixer Replenisher Used

| | |
|---|---|
| Ammonium thiosulfate | 100 g |
| Ammonium thiocyanate | 150 g |
| Anhydrous sodium bisulfite | 20 g |
| Sodium metabisulfite | 4.0 g |
| Disodium ethylenediaminetetraacetate | 1.0 g |

Water was added to reach a total quantity of 700 ml, and glacial acetic acid and aqueous ammonia were used to obtain a pH of 6.5.

Composition of the Stabilizer and Stabilizer Replenisher Used

| | |
|---|---|
| 1,2-benzoisothiazolin-3-one | 0.1 g |
| 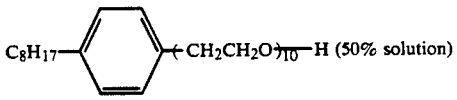 | 2.0 ml |
| Hexamethylenetetramine | 0.2 g |
| Hexahydro-1,3,5-tris-(2-hydroxyethyl)-5-triazine | 0.3 g |

Water was added to reach a total quantity of 1l, and potassium hydroxide and 50% sulfuric acid were used to obtain a pH of 7.0.

What is claimed is:

1. A silver halide color photographic light-sensitive material comprising a support having thereon a blue-sensitive silver halide emulsion layer, a green-sensitive silver halide emulsion layer and a red-sensitive silver halide emulsion layer, wherein the maximum sensitivity wavelength $\lambda_B$ of a spectral sensitivity distribution of said blue-sensitive layer is in the range of $$410\ \text{nm} \leqq \lambda_B \leqq 470\ \text{nm}; \text{ and}$$

the sensitivity of said blue-sensitive layer at 480 nm is not more than half of the sensitivity at said wavelength $\lambda_B$, the maximum sensitivity wavelength $\lambda_G$ of a spectral sensitivity distribution of said green-sensitive layer is in the range of $$530\ \text{nm} \leqq \lambda_G \leqq 560\ \text{nm}; \text{ and}$$

the sensitivity of said green-sensitive layer at 500 nm is not less than one-fourth of the sensitivity at the wavelength of $\lambda_G$.

2. A color photographic material of claim 1, wherein the maximum sensitivity wavelength $\lambda_R$ of spectral sensitivity distribution of said red-sensitive silver halide emulsion layer is in the range of $$595\ \text{nm} \leqq \lambda_R \leqq 625\ \text{nm}.$$

3. A color photographic material of claim 2, wherein said red-sensitive silver halide emulsion layer contains at least one of the sensitizing dyes represented by Formula (I) and at least one of the sensitizing dyes represented by Formula (II) or (III), Formula (I)

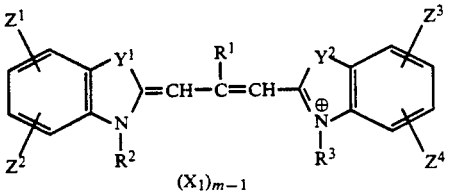

wherein $R^1$ represents a hydrogen atom, an alkyl group or aryl group; $R^2$ and $R^3$ independently represent an alkyl group; $Y^1$ and $Y^2$ independently represent a sulfur or selenium atom; $Z^1$, $Z^2$, $Z^3$ and $Z^4$ independently represent a hydrogen atom, a halogen atom, a hydroxyl group, an alkoxy group, an amino group, an acyl, acylamino or acyloxy group, an alkoxycarbonyl group, an aryl group, an aryloxy or aryloxycarbonyl group, a sulfonyl group, a carbamoyl group, an alkyl group or a cyano group, $Z^1$ and $Z^2$ and/or $Z^3$ and $Z^4$ may bond with each other to form a ring; $X_1$ represents a cation; and m represents an integer of 1 or 2, or represents 1 provided that the sensitizing dye (I) forms an intramolecular salt, Formula (II)

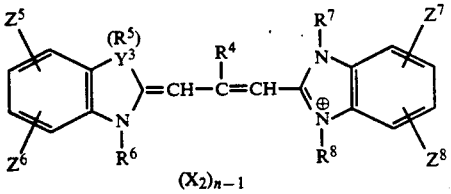

wherein $R^4$ represents a hydrogen atom, an alkyl group or an aryl group; $R^5$, $R^6$, $R^7$ and $R^8$ independently represent an alkyl group; $Y^3$ represents a nitrogen atom, a sulfur or selenium atom, and no $R^5$ exists when $Y^3$ is a sulfur or selenium atom; $Z^5$, $Z^6$, $Z^7$ and $Z^8$ independently represent a hydrogen atom, a halogen atom, a hydroxyl group, an alkoxy group, an amino group, an acyl group, an acylamino or acyloxy group, an aryloxy group, an alkoxycarbonyl or aryloxycarbonyl group, an alkoxycarbonylamino group, a carbamoyl group, an aryl group, an alkyl group, a cyano group, or a sulfonyl group, $Z^5$ and $Z^6$ and/or $Z^7$ and $Z^8$ may bond with each other to form a ring; $X_2$ represents a cation; and n represents an integer of 1 or 2, or represents 1 provided that the sensitizing dye (II) forms an intramolecular salt, Formula (III)

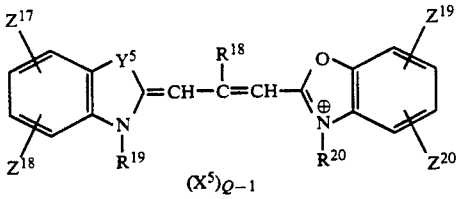

wherein $Y^5$ represents a sulfur or selenium atom; $R^{18}$ represents a hydrogen atom, an alkyl group or an aryl group; $R^{19}$ and $R^{20}$ individually represent an alkyl group; $Z^{17}$, $Z^{18}$, $Z^{19}$ and $Z^{20}$ independently a hydrogen atom, a halogen atom, a hydroxy group, an alkoxy group, an amino or acylamino group, an acyloxy group, an akoxycarbonyl or alkoxycarbonylamino group, an aryl group, an alkyl group, $Z^{17}$ and $Z^{18}$ and/or $Z^{19}$ and $Z^{20}$ may bond with each other to form a ring; $X^5$ represents a cation; and Q represents an integer of 1 or 2, or represents 1 provided that the sensitizing dye (III) forms an intramolecular salt.

4. A color photographic material of claim 3, wherein said red-sensitive silver halide emulsion layer contains at least one of the sensitizing dyes represented by Formula (I) and at least one of the sensitizing dyes represented by Formula (II).

5. A color photographic material of claim 3, wherein $Y^1$ and $Y^2$ in Formula (I) is sulfur atoms and $Y^3$ in Formula (II) represents $N—R^a$, wherein N represents a nitrogen atom and $R^a$ represents an alkyl group.

6. A color photographic material of claim 1, wherein the maximum sensitivity of said red-sensitive silver halide emulsion layer in the wavelength ranging from 400 nm to 480 nm is not less than 1.5% of the sensitivity of said blue-sensitive silver halide emulsion layer at the wavelength of said $\lambda_B$.

7. A color photographic material of claim 6, wherein a cyan coupler is contained in said blue-sensitive silver halide emulsion layer.

8. A color photographic material of claim 7, wherein said cyan coupler is represented by the following formula [CII], [CIII] or [CIV], formula [CII]

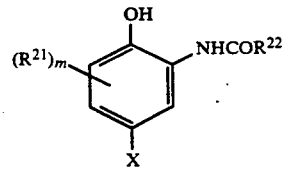

formula [CII]

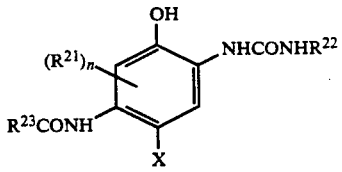

formula [CIV]

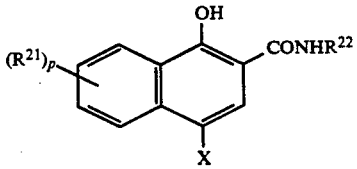

wherein $R^{21}$ represents a hydrogen atom or a substituent; $R^{22}$ and $R^{23}$ independently represent a substituent; m represents an integer of 1 to 3; n represents 1 or 2; p represents 1 to 5; when m,n or p is 2 or more, the $R^{21}$ units may be identical or not; and X represents a hydrogen atom or a group which is released upon reaction with the oxidation product of an aromatic primary amine color-developer.

9. A color photographic material of claim 4, wherein $Y^1$ and $Y^2$ in Formula (I) is a sulfur atom and $Y^3$ in Formula (II) represents $N—R_a$, wherein N represents an nitrogen atom and $R_a$ represents an alkyl group.

* * * * *